US010676967B2

(12) United States Patent
Schwickerath et al.

(10) Patent No.: US 10,676,967 B2
(45) Date of Patent: Jun. 9, 2020

(54) ROTARY LATCH WITH MODULAR COMPONENTS

(71) Applicant: TriMark Corporation, New Hampton, IA (US)

(72) Inventors: Tobias J. Schwickerath, New Hampton, IA (US); Dennis J. Zweibohmer, Ionia, IA (US); Shayne E. Dodge, New Hampton, IA (US); Gene C. Light, Denver, IA (US); Matthew L. Hidding, Elma, IA (US)

(73) Assignee: Trimark Corporation, New Hampton, IA (US)

( * ) Notice: Subject to any disclaimer, the term of this patent is extended or adjusted under 35 U.S.C. 154(b) by 197 days.

(21) Appl. No.: 15/068,197

(22) Filed: Mar. 11, 2016

(65) Prior Publication Data

US 2017/0260774 A1 Sep. 14, 2017

(51) Int. Cl.

| | |
|---|---|
| ***E05B 63/04*** | (2006.01) |
| ***E05B 85/02*** | (2014.01) |
| ***E05B 79/06*** | (2014.01) |
| ***E05B 63/00*** | (2006.01) |
| ***E05B 79/08*** | (2014.01) |

(52) U.S. Cl.

CPC ..... *E05B 63/044* (2013.01); *E05B 63/0056* (2013.01); *E05B 63/042* (2013.01); *E05B 79/06* (2013.01); *E05B 79/08* (2013.01); *E05B 85/02* (2013.01); *Y10T 292/1047* (2015.04); *Y10T 292/1062* (2015.04); *Y10T 292/1082* (2015.04); *Y10T 292/1092* (2015.04)

(58) Field of Classification Search

CPC .. E05B 63/044; E05B 63/0056; E05B 63/042; E05B 79/06; E05B 79/08; E05B 85/00; Y10T 292/1082; Y10T 292/1092; Y10T 292/1047; Y10T 292/1062

USPC ..... 292/229, 216, DIG. 23, 201, 210

See application file for complete search history.

(56) References Cited

U.S. PATENT DOCUMENTS

| | | | | |
|---|---|---|---|---|
| 295 A | | 7/1837 | Snider | |
| 5,564 A | | 5/1848 | Brewer | |
| 2,888,288 A | * | 5/1959 | Rigaud | E05C 3/28 292/46 |

(Continued)

FOREIGN PATENT DOCUMENTS

| | | |
|---|---|---|
| DE | 202008000560 U1 | 4/2008 |
| EP | 1039079 A1 | 9/2000 |

(Continued)

OTHER PUBLICATIONS

13140 NGL Patent Review—Rev 1, 1 page Sep. 19, 2014.

*Primary Examiner* — Kristina R Fulton
*Assistant Examiner* — Faria F Ahmad
(74) *Attorney, Agent, or Firm* — McKee, Voorhees & Sease, PLC

(57) ABSTRACT

A rotary latch assembly is provided which can be configured as right-handed and left-handed using the same rotor and catch components, without reconfiguring the front and back plates. The axles for the rotor and catch are identical so that the rotor and catch can be interchanged on the axles. The latch biasing springs are mirror images so as to be used on either the rotor or the catch. The latch includes multiple connection points for single or dual actuators, and a lifting block to align the assembly with a striker.

32 Claims, 24 Drawing Sheets

(56) References Cited

U.S. PATENT DOCUMENTS 3,014,417 A * 12/1961 Maiershofer ..... G03B 9/10 396/493
4,602,813 A 7/1986 Gergoe et al.
4,703,961 A 11/1987 Weinerman et al.
4,763,934 A 8/1988 Kaveney, Jr.
4,896,906 A 1/1990 Weinerman et al.
4,917,412 A 4/1990 Swan et al.
5,069,491 A 12/1991 Weinerman et al.
5,127,686 A 7/1992 Gleason et al.
5,186,504 A 2/1993 Takaishi et al.
5,299,844 A 4/1994 Gleason
5,316,351 A 5/1994 Czimny et al.
5,439,260 A 8/1995 Weinerman et al.
5,564,295 A 10/1996 Weinerman et al.
5,586,458 A 12/1996 Weinerman et al.
5,595,076 A 1/1997 Weinerman et al.
5,611,224 A 3/1997 Weinerman et al.
5,884,948 A 3/1999 Weinerman et al.
6,012,747 A 1/2000 Takamura et al.
6,149,210 A 11/2000 Hunt et al.
6,158,787 A 12/2000 Kutschat
6,419,284 B1 7/2002 Kutschat
6,454,321 B1 9/2002 Parikh
6,471,260 B1 10/2002 Weinerman et al.
6,494,506 B1 * 12/2002 Gleason ..... E05B 83/36 292/216
6,497,436 B1 12/2002 DeBlock et al.
6,557,909 B2 * 5/2003 Morris ..... E05B 59/00 292/169.15
6,629,711 B1 * 10/2003 Gleason ..... E05B 83/36 292/201
6,651,466 B1 * 11/2003 Shih ..... E05B 63/044 292/165
6,651,467 B1 11/2003 Weinerman et al.
6,695,361 B1 2/2004 Gleason et al.
6,942,259 B2 * 9/2005 Marzolf ..... E05B 85/247 292/216
6,962,375 B2 11/2005 Linares
7,040,675 B1 * 5/2006 Ott ..... B60J 7/19 292/123
7,055,874 B1 7/2006 Jeffries et al.
7,108,300 B2 * 9/2006 Hodgin ..... E05B 63/044 292/244
7,137,656 B2 11/2006 Bird et al.
7,140,649 B1 11/2006 Gregory
7,156,430 B2 1/2007 Hidding et al.
7,267,377 B2 9/2007 Marzolf et al.
7,267,380 B2 9/2007 Bullock et al.
7,309,087 B2 12/2007 Lane et al.
7,320,488 B2 1/2008 Hidding et al.
7,338,097 B2 3/2008 Marzolf et al.
7,497,488 B2 3/2009 Chen
7,513,541 B1 4/2009 Gregory
7,611,173 B2 11/2009 Helton et al.
7,726,707 B2 7/2010 Simchayoff et al.
7,861,475 B2 1/2011 Sprague
7,938,458 B1 5/2011 Zweibohmer et al.
8,075,027 B2 * 12/2011 Zweibohmer ..... E05C 3/24 292/216
8,382,168 B2 * 2/2013 Carabalona ..... E05B 47/004 292/216
8,801,052 B2 8/2014 Bender
8,894,105 B2 11/2014 Kutschat et al.
9,004,550 B2 * 4/2015 Carabalona ..... E05B 77/06 292/251.5
2003/0006618 A1 * 1/2003 Kalsi ..... E05B 81/06 292/201
2005/0140146 A1 * 6/2005 Spurr ..... E05B 17/007 292/216
2005/0206172 A1 * 9/2005 Bacon ..... E05B 17/0004 292/216
2006/0006667 A1 * 1/2006 Hidding ..... E05B 85/02 292/216
2006/0006668 A1 * 1/2006 Hidding ..... E05B 85/02 292/216
2006/0012184 A1 * 1/2006 Ottesen ..... E05C 3/24 292/216
2006/0208505 A1 * 9/2006 Christoffel ..... B60N 2/366 292/216
2008/0217929 A1 * 9/2008 Zweibohmer ..... E05C 3/24 292/216
2010/0327610 A1 * 12/2010 Nakanishi ..... E05B 63/185 292/162
2014/0035293 A1 2/2014 Weinerman et al.
2015/0033808 A1 * 2/2015 Taylor ..... E05B 47/0603 70/101

FOREIGN PATENT DOCUMENTS

EP 1357246 A1 10/2003
FR 2937071 A1 10/2014
GB 2447357 B 7/2011
WO 02079598 A2 10/2002

* cited by examiner

ROTARY LATCH WITH MODULAR COMPONENTS

BACKGROUND OF THE INVENTION

Latches for doors on vehicles are typically manufactured for either the left-hand or right-hand side of the vehicle. Therefore, manufacture of these left and right-handed latches require different components and different assembly lines. For example, in a rotary latch, the rotor and catch for a left-handed latch assembly have a mirror image from the rotor and catch in a right-handed latch assembly. These different components for the different handed latches increases inventory, manufacturing time, and costs.

Non-handed latches are known for use on either the left or right door. These non-handed latches typically require the reversal of many of the components. For example, see U.S. Pat. No. 8,075,027 wherein the second plate is reversed from a left-handed latch to a right-handed latch. Such reversal of components increases the complexity of the assembly process.

Therefore, there is a need for a simplified non-handed latch and assembly process for use in left and right-handed applications.

Accordingly, a primary objective of the present invention is the provision of a rotary latch with modular components which can be more easily assembled for use in left and right handed applications.

Another objective of the present invention is the provision of a rotary latch having front and back plates which are connected in the same configuration for both left and right handed applications.

Another objective of the present invention is the provision of a rotary latch assembly having front and back plates, each having opposite ends which are symmetrical about a mid-line of the plates.

Still another objective of the present invention is the provision of a rotary latch assembly having non-handed components which can be assembled to form both left and right-handed latches.

A further objective of the present invention is the provision of a rotary latch assembly having multiple trip lever locations for left and right handed applications.

Another objective of the present invention is the provision of a rotary latch assembly having a lift block on the latch to facilitate alignment of the latch with a striker.

Still another objective of the present invention is the provision of an improved rotary latch having simplified assembly and minimizing the components required for building left-handed and right-handed latch assemblies.

These and other objectives will become apparent from the following description of the invention.

SUMMARY OF THE INVENTION

The latch assembly of the present invention includes a front plate and a back plate which are assembled together in a single orientation or configuration, regardless of left hand or right hand applications. The latch assembly includes a rotor and catch mounted on axles extending between the front and back plates. The rotor and catch are interchangeable on the axles to form left hand or right hand latches. Mirror image springs can be used on either the rotor or the catch for both the left and right hand latch assemblies. Single or dual actuators or trip levers can be mounted at multiple locations on the front and back plates, if needed. The back plate includes a tab which limits the rotational movement of a trip lever.

DETAILED DESCRIPTION OF THE INVENTION

Figure 1:
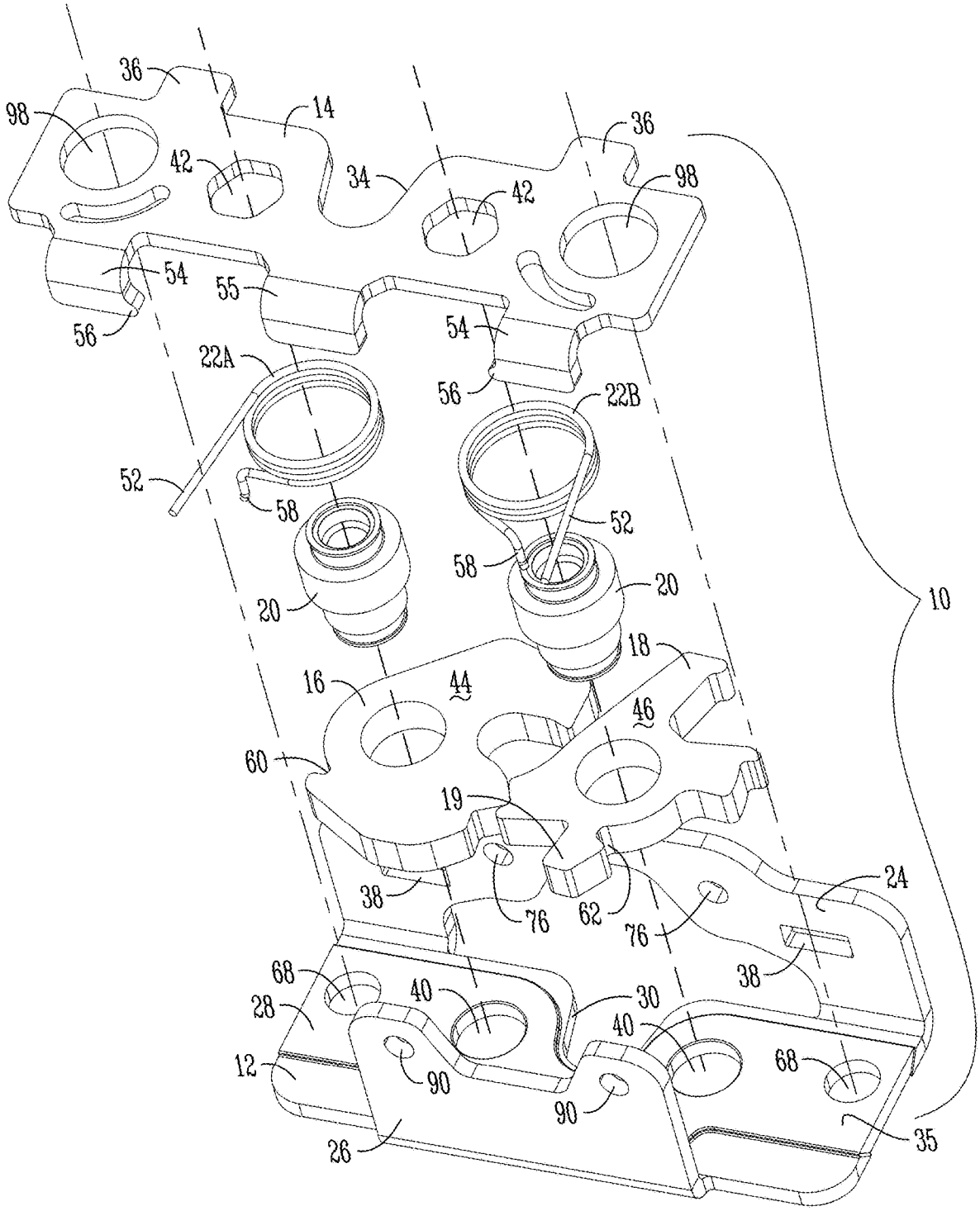
FIG. 1 is an exploded perspective view of the latch assembly of the present invention assembled for a right-handed application.

The latch assembly 10 of the present invention includes modular components which allow the latch to be assembled for right-handed applications, as shown in FIGS. 1-5, and for left-handed applications, as shown in FIGS. 6-10. The latch assembly 10 includes only eight primary components for use in the right and left-handed applications. These components include a front plate 12, a back plate 14, a rotor 16, a catch 18, a pair of identical axles 20, and a pair of mirror image springs 22A and 22B.

Figure 22:
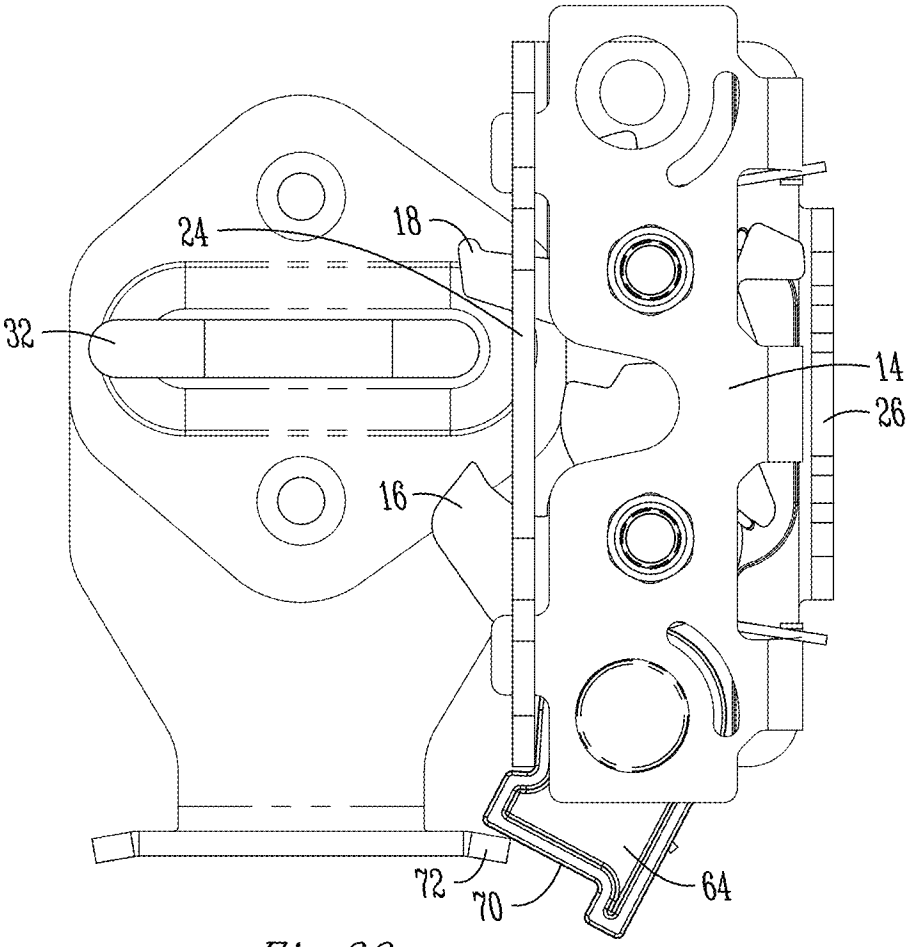
FIG. 22 is a view similar to FIG. 21, with the latch assembly in an unlatched position and shown adjacent to the striker which is showing engagement with the lifting block.
Figure 21:
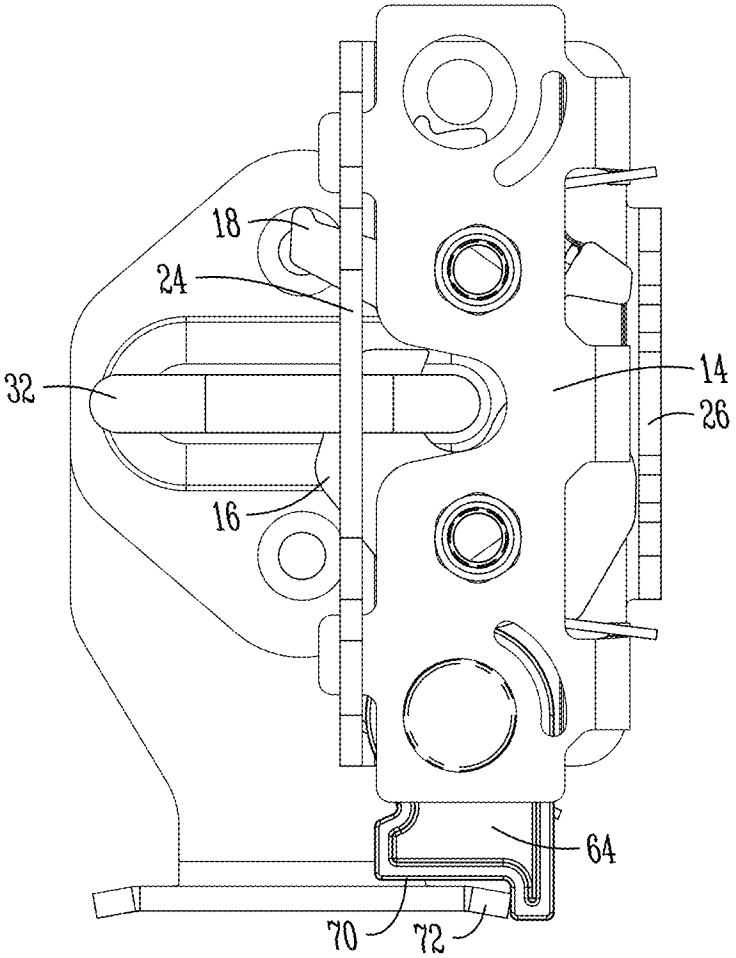
FIG. 21 is a plan view showing the latch assembly of FIG. 17 in a latched position with a striker.
Figure 23:
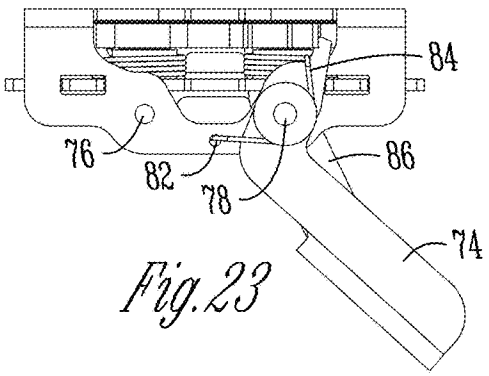
FIG. 23 is a top plan view of a right-handed latch assembly with dual trip levers mounted in a first position on the front plate.
Figure 24:
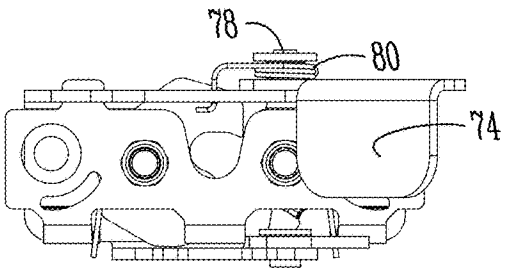
FIG. 24 is a front elevation view of the latch assembly shown in FIG. 23.
Figure 25:
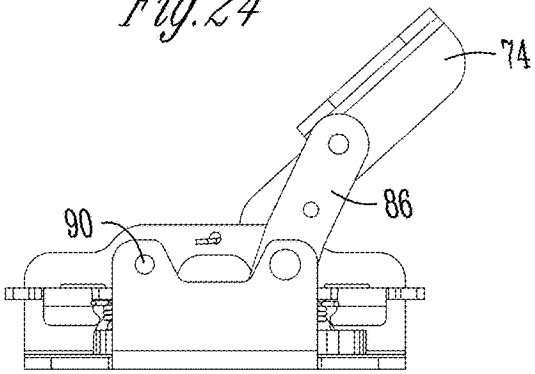
FIG. 25 is a bottom plan view of the latch assembly shown in FIG. 23.
Figure 26:
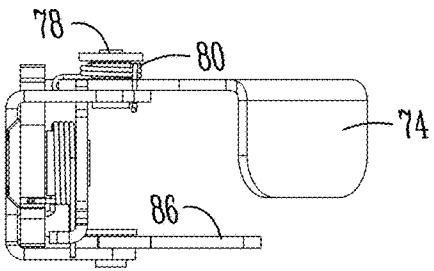
FIG. 26 is a left end view of the latch assembly shown in FIG. 23.

The front plate 12 is C-shaped, with a top flange 24, a bottom flange 26, and an interconnecting front face 28. The front plate 12 includes a window 30 for receipt of a striker 32, as seen in FIGS. 21 and 22. The back plate 14 has a similar window or notch 34 for receipt of the striker. An embossment 35 extends continuously along the length of the front face 28. The embossment 35 adds strength to the front plate 12 and provides a support surface for the rotor 16 and the catch 18. Since the width of the embossment 35 is less than the diameters of the rotor and the catch, contact friction between the rib and the rotor/catch is minimized.

The back plate 14 includes a pair of tabs 36 for receipt in a pair of slots 38 in the top flange 24 of the front plate 12. This mounting configuration of the back plate 14 to the front plate 12 via the tabs 36 and the slots 38 is the same for both the right-handed and left-handed latch assemblies.

The axles 20 are mounted between the front plate 12 and the back plate 14. The front plate 12 includes a pair of holes 40 for receiving one end of the axles 20, and the back plate 14 includes a pair of holes 42 to receive the opposite end of the axles 20. Preferably, the holes 42 are hex-shaped to reduce axle spin during staking. The hex holes 42 let the axles 20 form into the corners of the hex, which allows a greased axle to achieve the desired axle torque during assembly. Thus, the hex holes 42 increase axle torque resistance after the axles are assembled in the front and back plates 12, and 14.

Figure 6:
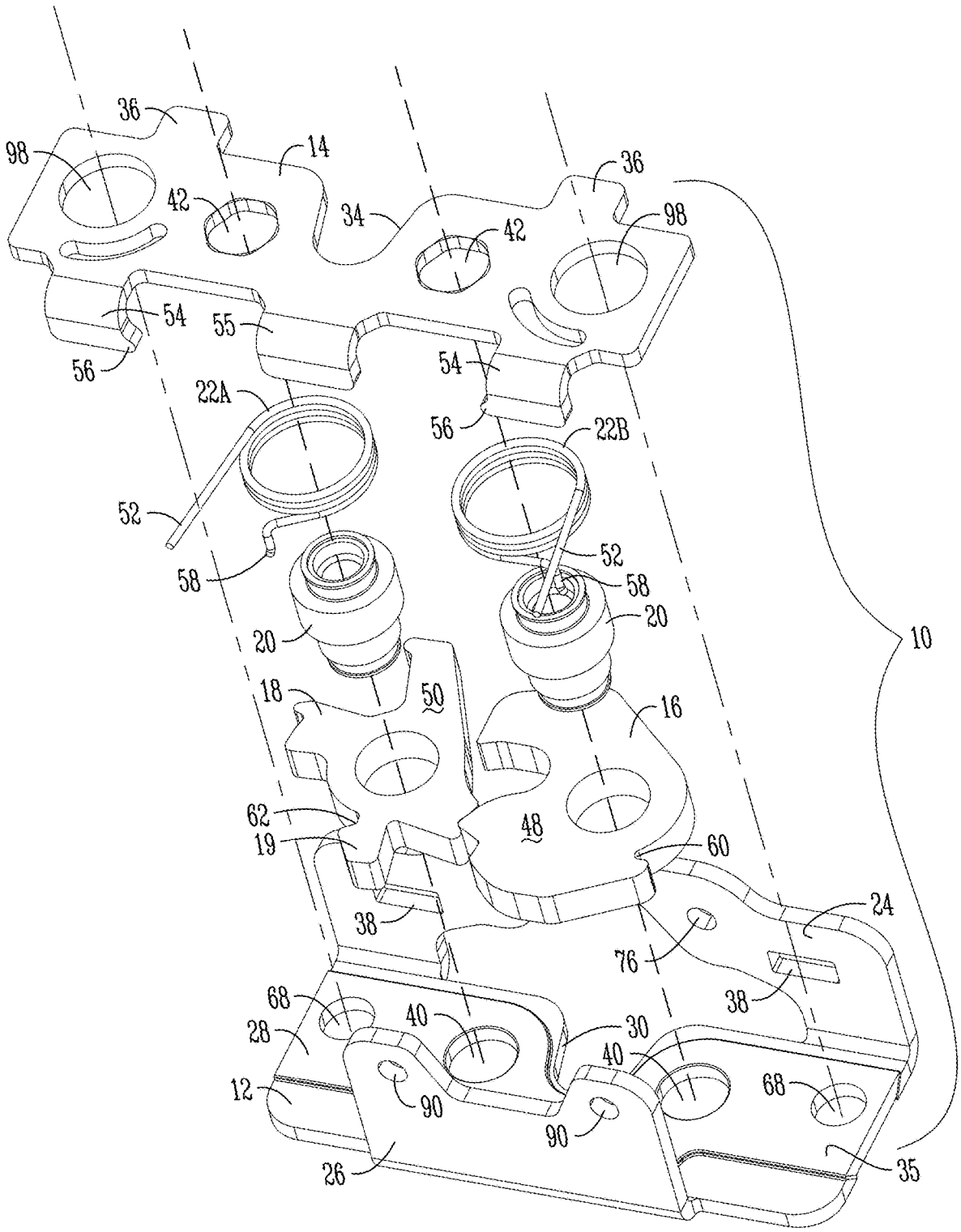
FIG. 6 is an exploded perspective view of the latch assembly, with the components arranged to form a left-handed latch.
Figure 7:
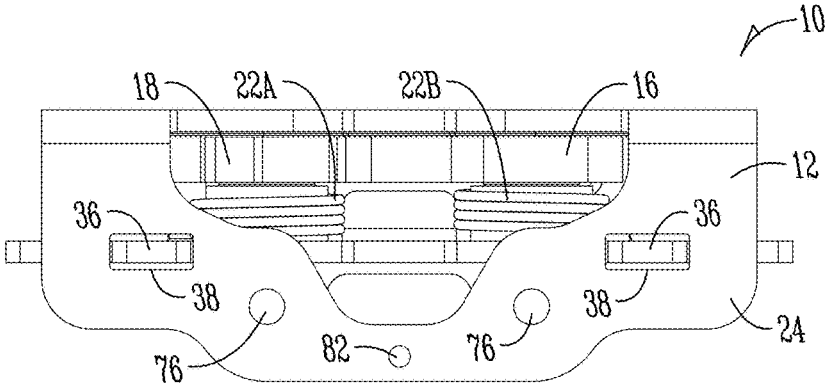
FIG. 7 is a top plan view of the latch assembly shown in FIG. 6.
Figure 8:
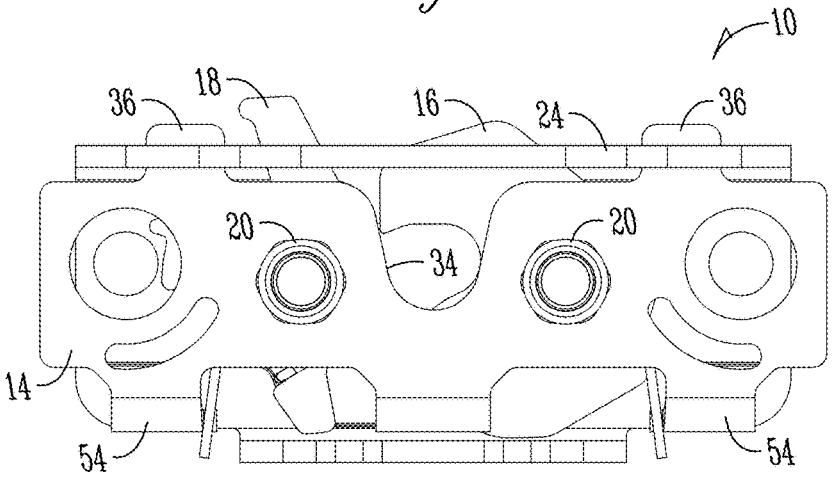
FIG. 8 is front elevation view of the latch assembly shown in FIG. 6, with the rotor and catch in a latched position.
Figure 9:
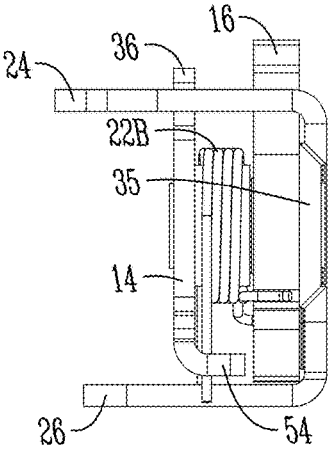
FIG. 9 is a right end view of the latch assembly shown in FIG. 6.
Figure 10:
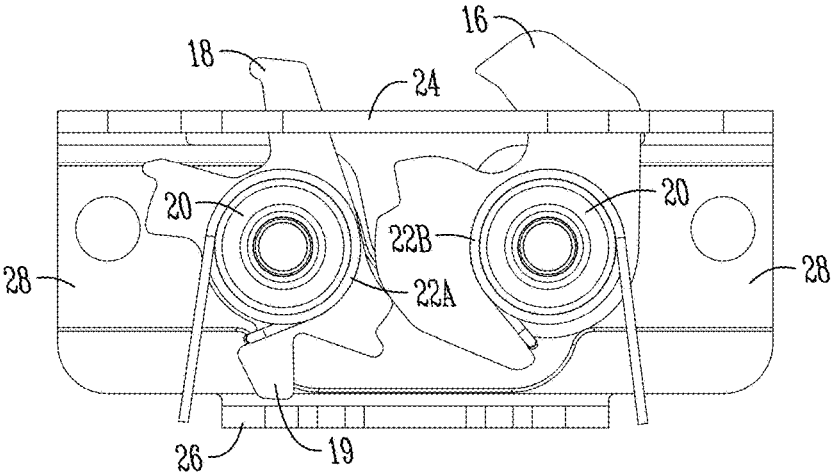
FIG. 10 is a view similar to FIG. 8, with the back plate removed to show the internal components, with the rotor and catch in an unlatched position.

The rotor 16 and the catch 18 are mounted on the axles 20 for rotation about the axle axes between latched and unlatched positions (FIGS. 21 and 22, respectively) relative to a striker 32. The rotor 16 and the catch 18 can be exchanged or interchanged on the pair of axles 20 so as to form a right-handed latch, as shown in FIGS. 1-5, or a left-handed latch, as shown in FIGS. 6-10. The rotor 16 and the catch 18 are flipped 180 degrees between the right-hand and left-hand configurations, as best seen in FIGS. 1 and 6. Thus, in a right hand configuration, a first face 44 of the rotor 16 and a first face 46 of the catch face towards the back plate 14. In the left-hand configuration, a second face 48 of the rotor 16 and a second face 50 of the catch 18 face toward the back plate 14.

Figure 27:
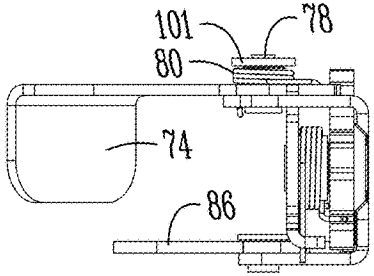
FIG. 27 is a right end view of the latch assembly shown in FIG. 23.
Figure 28:
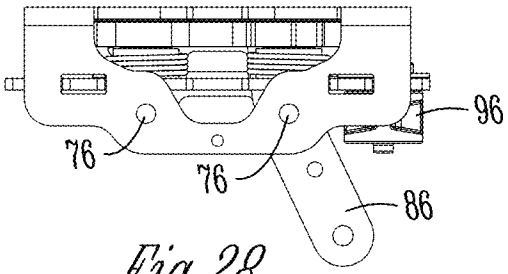
FIG. 28 is a top plan view of a right-handed latch assembly with an alternative trip lever mounted in a second position on the front plate, and having a rotary actuator.
Figure 29:
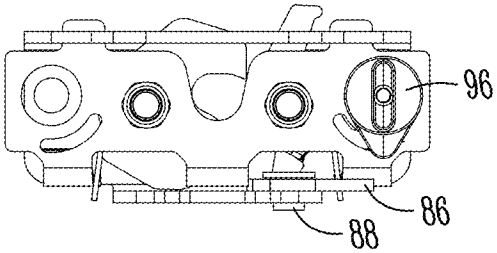
FIG. 29 is a front elevation view of the latch assembly shown in FIG. 28.
Figure 30:
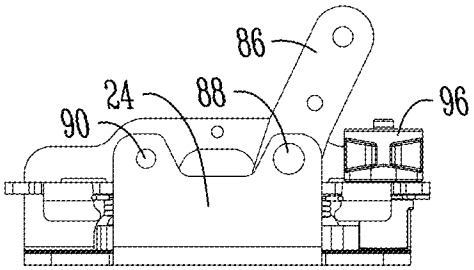
FIG. 30 is a bottom plan view of the latch assembly shown in FIG. 28.
Figure 31:
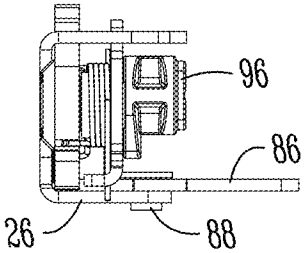
FIG. 31 is a left end view of the latch assembly shown in FIG. 28.
Figure 32:
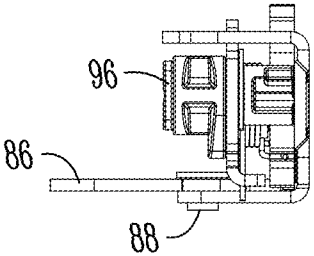
FIG. 32 is a right end view of the latch assembly shown in FIG. 28.
Figure 33:
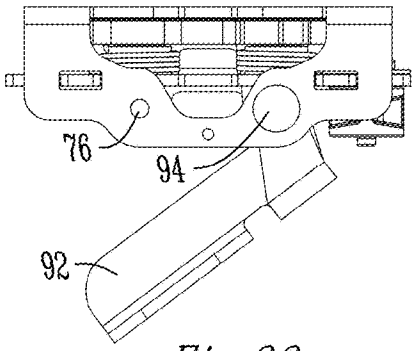
FIG. 33 is a top plan view of a right-handed latch assembly with a coaxially mounted trip lever mounted in a first position on the front plate.
Figure 34:
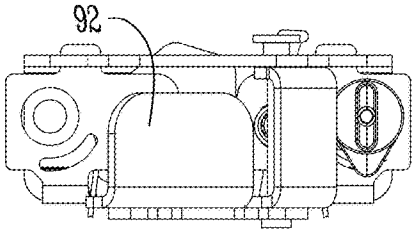
FIG. 34 is a front elevation view of the latch assembly shown in FIG. 33.
Figure 35:
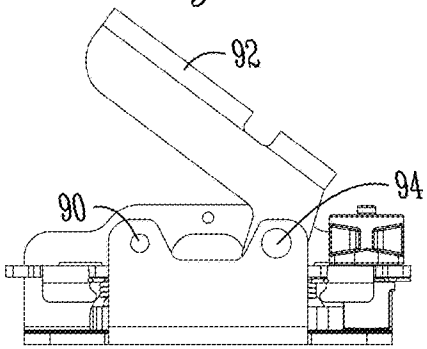
FIG. 35 is a bottom plan view of the latch assembly shown in FIG. 33.
Figure 36:
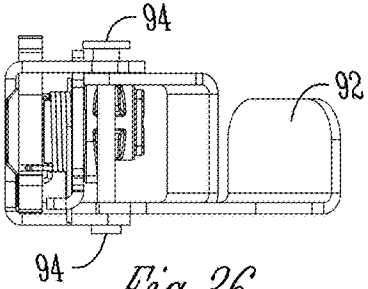
FIG. 36 is a left end view of the latch assembly shown in FIG. 33.
Figure 37:
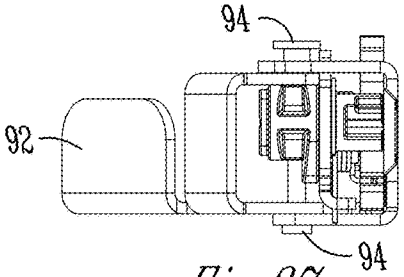
FIG. 37 is a right end view of the latch assembly shown in FIG. 33.
Figure 38:
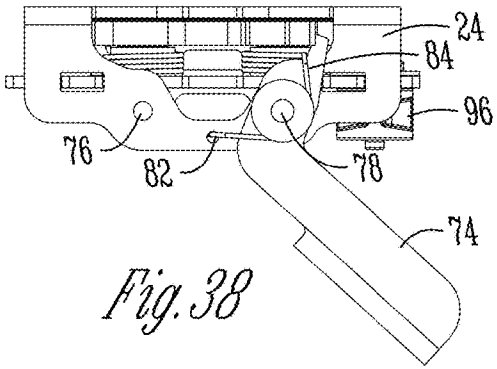
FIG. 38 is a top plan view of a right-handed latch assembly with a trip lever and a rotary actuator mounted on the front plate.
Figure 39:
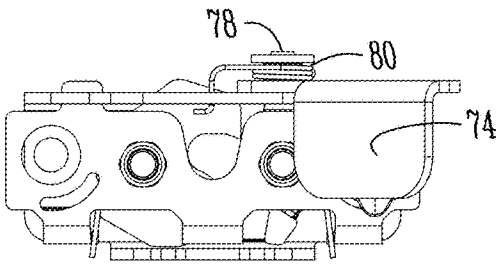
FIG. 39 is a front elevation view of the latch assembly shown in FIG. 38.
Figure 40:
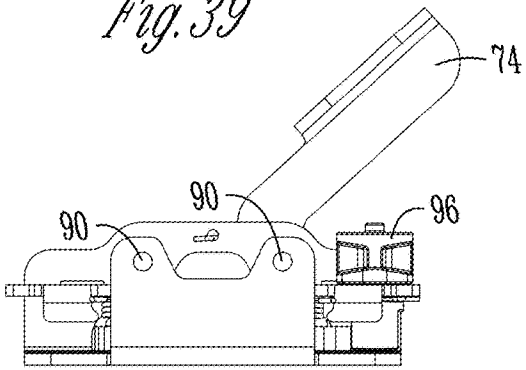
FIG. 40 is a bottom plan view of the latch assembly shown in FIG. 38.
Figure 41:
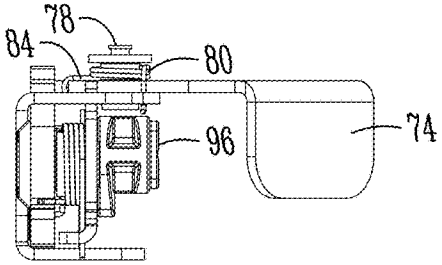
FIG. 41 is a left end view of the latch assembly shown in FIG. 38.
Figure 42:
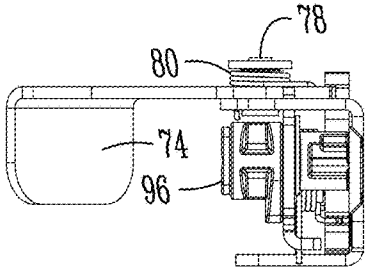
FIG. 42 is a right end view of the latch assembly shown in FIG. 38.
Figure 43:
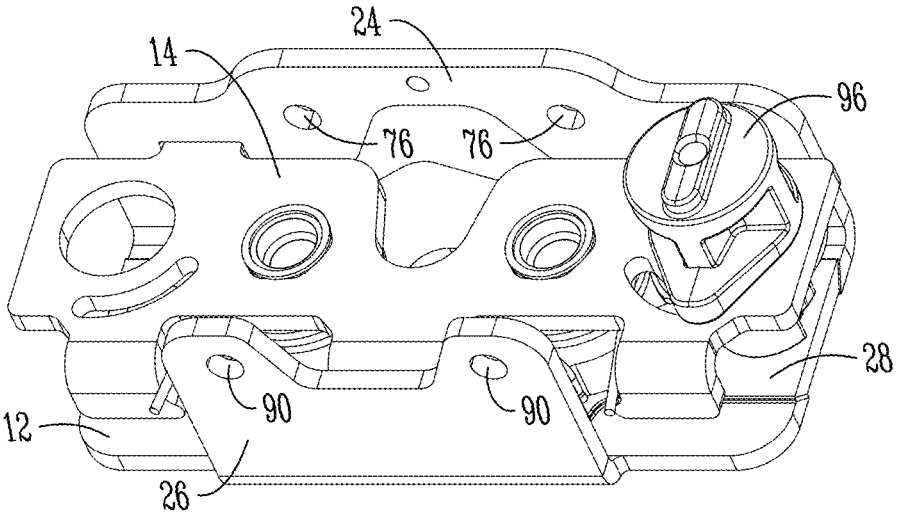
FIG. 43 is a perspective view of a latch assembly according to the present invention having a barrel actuator mounted on the back plate.
Figure 44:
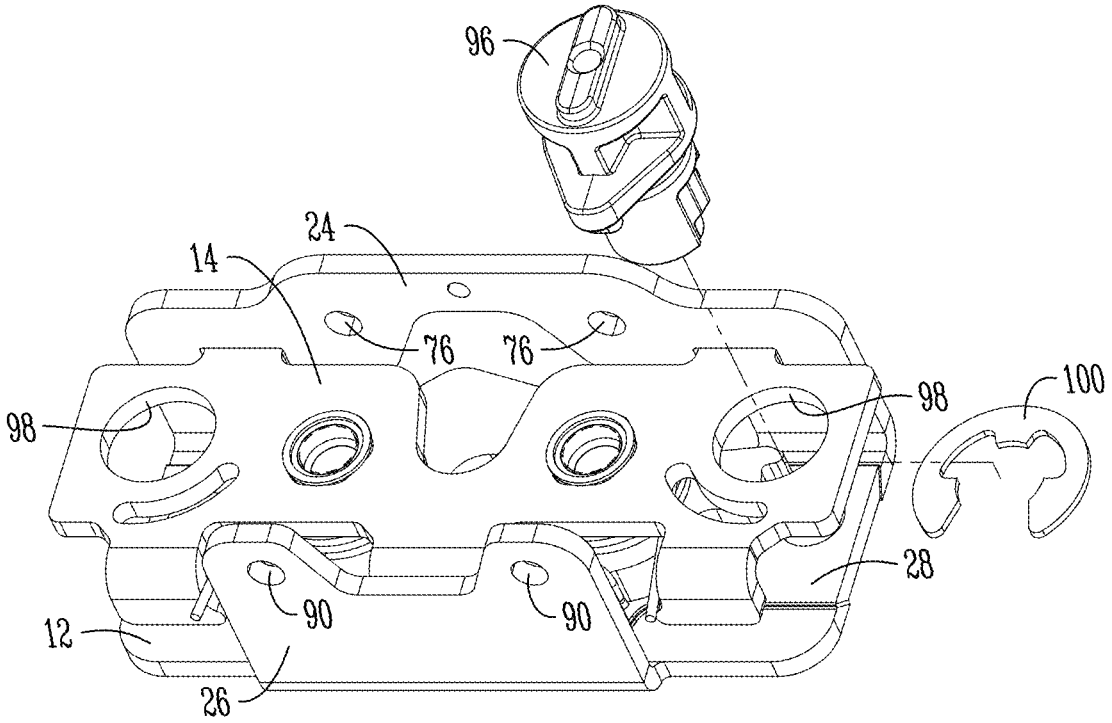
FIG. 44 is a partially exploded perspective view of the latch assembly shown in FIG. 43.
Figure 45:
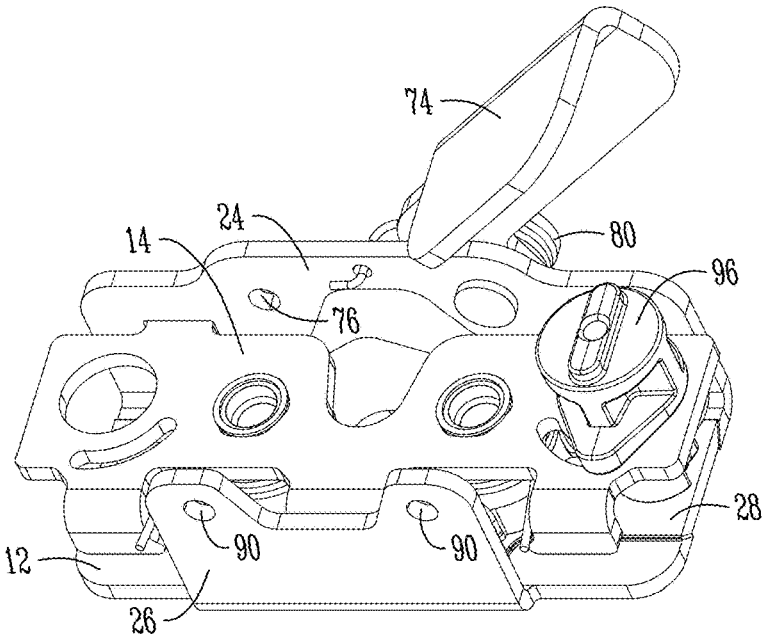
FIG. 45 is a perspective view of a latch assembly according to the present invention with a trip lever and a barrel actuator.
Figure 46:
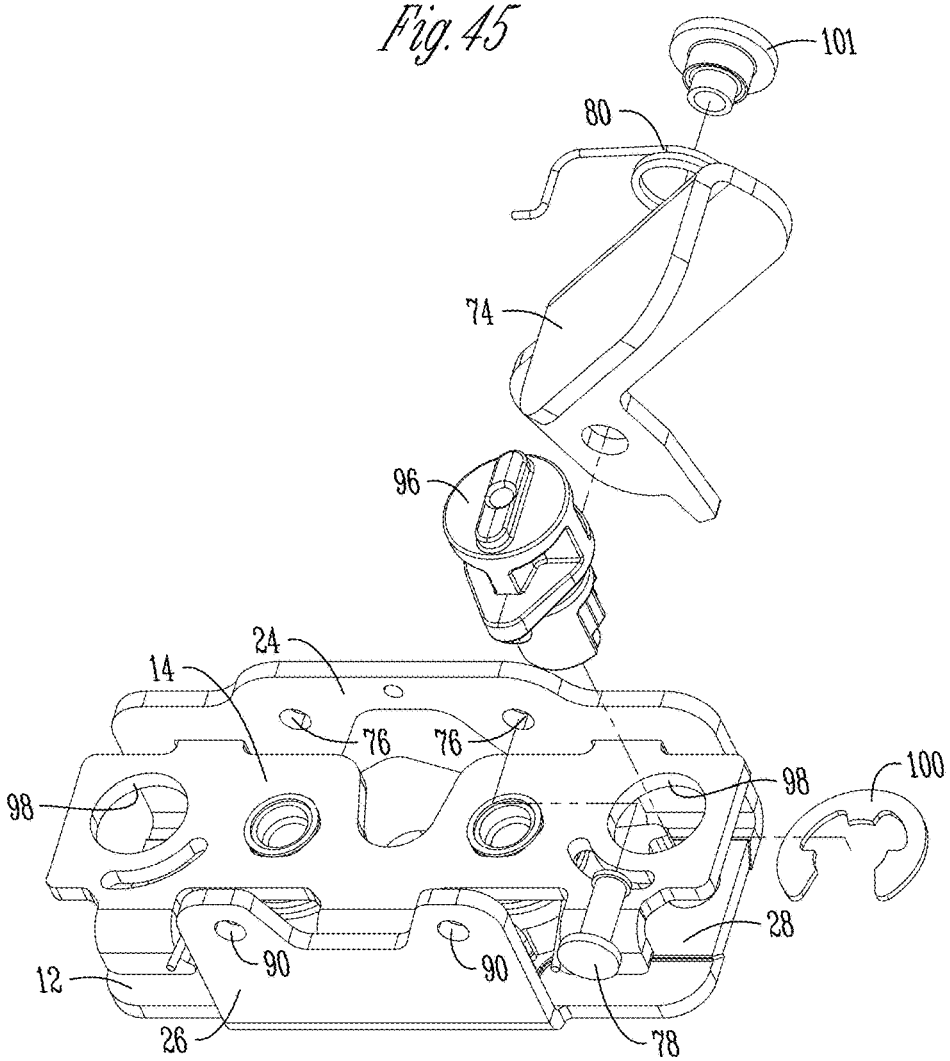
FIG. 46 is a partially exploded view of the latch assembly shown in FIG. 45.
Figure 47:
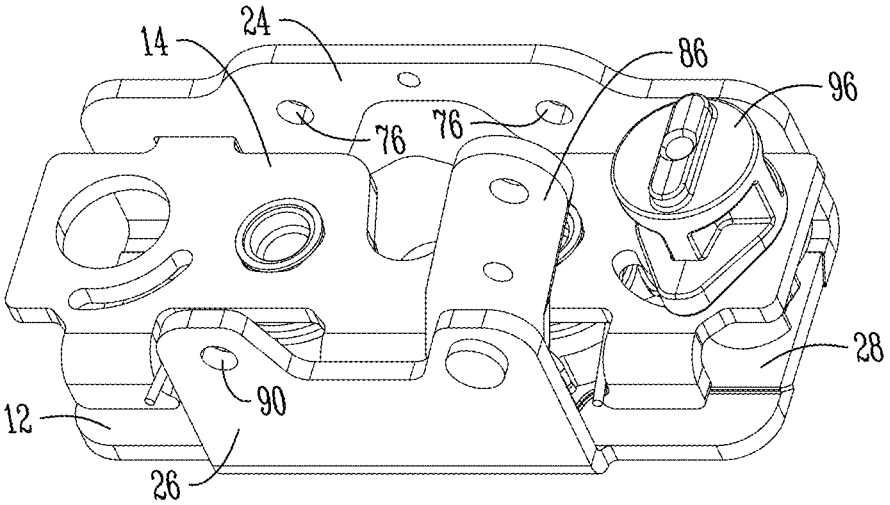
FIG. 47 is a perspective view of the assembly of the present invention having an alternative trip lever and rotational actuator.
Figure 48:
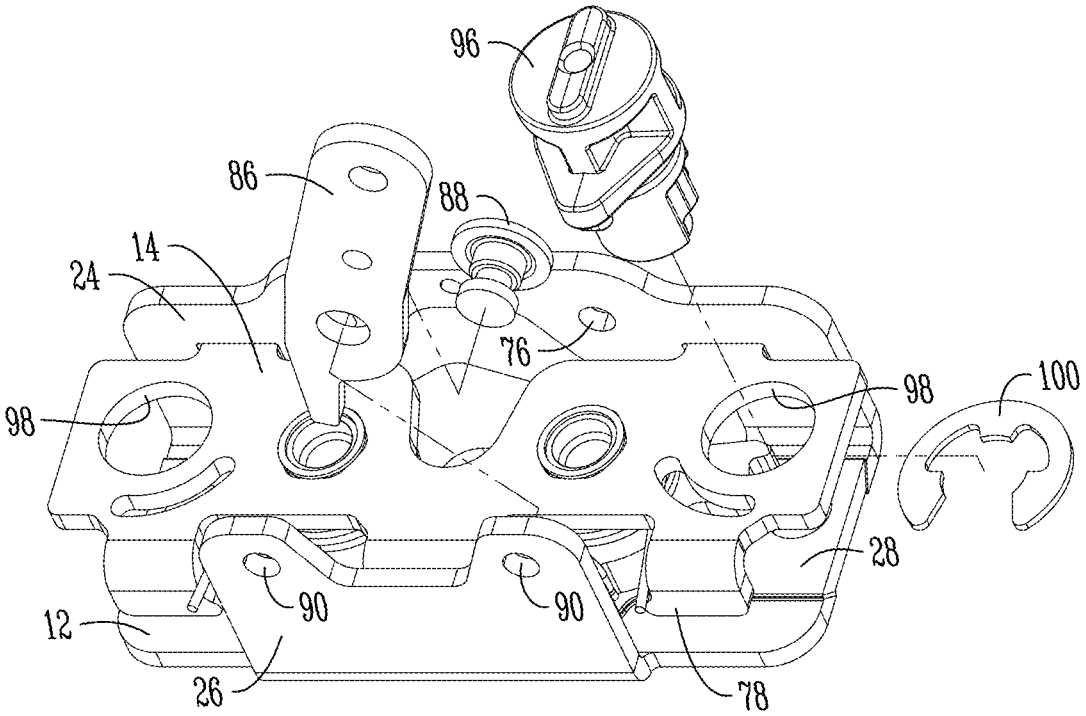
FIG. 48 is a partially exploded perspective view of the latch assembly shown in FIG. 47.
Figure 49:
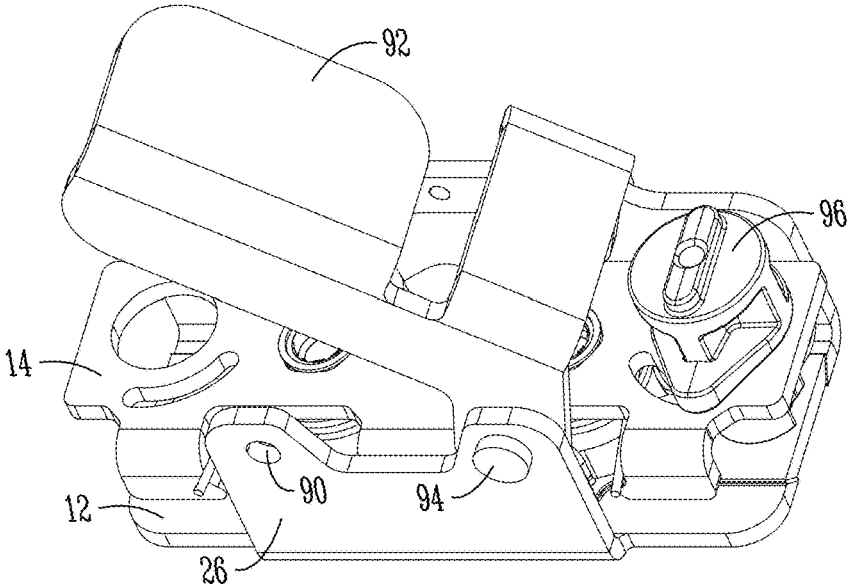
FIG. 49 is a perspective view of a latch assembly according to the present invention having coaxial trip lever and a rotational actuator.
Figure 50:
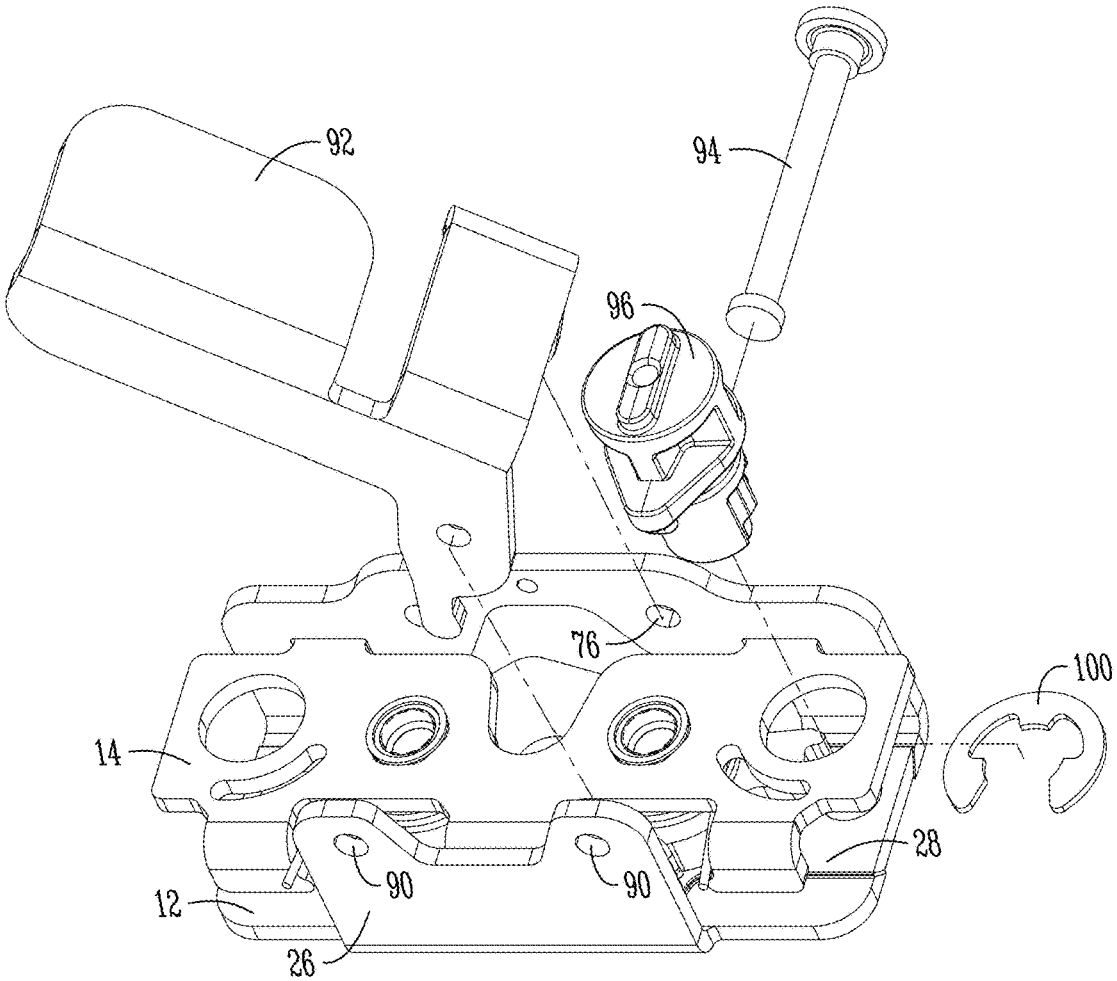
FIG. 50 is a partially exploded perspective view of the latch assembly shown in FIG. 49.

The springs 22A and 22B are mounted on the axles 20. A first end 52 of each spring 22 is retentively engaged on a pair of outer tabs 54 on the back plate 14. Preferably, each tab 54 has a small hook 56 to facilitate retention of the spring end 52. The second end 58 of each spring 22A and 22B is retentively received in a notch or hook 60, 62 on the rotor 16 and on the catch 18, respectively. The mirror image configuration of the springs 22A and 22B allow each spring to be used with both the rotor 16 and the catch 18, depending on the right hand and left hand orientation of the rotor and the catch. The springs 22 bias the rotor 16 towards the unlatched position and bias the catch 18 towards the latched position. A center tab 55 on the back plate 14 limits the rotation of a trip lever such as 86 shown in FIGS. 27-28, when trip lever 86 is pivotally mounted to back plate 12 at one of the mounting holes 90.

Figure 11:
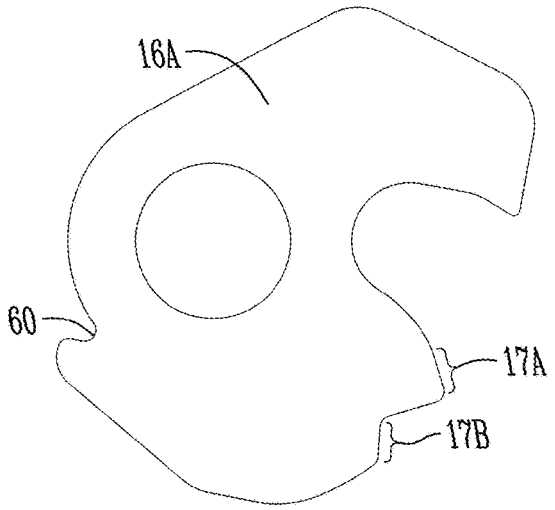
FIG. 11 is a plan view of a two-position rotor for use in the latch assembly of the present invention.
Figure 12:
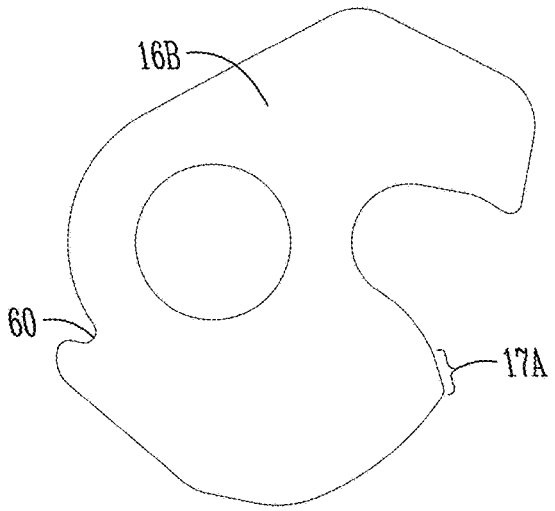
FIG. 12 is a plan view of a one-position rotor for use in the latch assembly of the present invention.

The latch assembly 10 of FIGS. 1 and 6 can be used on the left and right passenger doors of a vehicle, as well as on other vehicle compartment doors. For the primary vehicle doors which allow a driver and passenger to enter and exit the vehicle, a two-position rotor 16A is used, as shown in FIG. 11, as required by Government regulations. For other compartment doors, a single position rotor 16B can be used, as shown in FIG. 12. The two-position rotor 16A includes a first engagement point 17A and a second engagement point 17B for the catch 18A, whereas the single position rotor 16B only has the first engagement point 17A and not the second engagement point 17B.

Figure 1A:
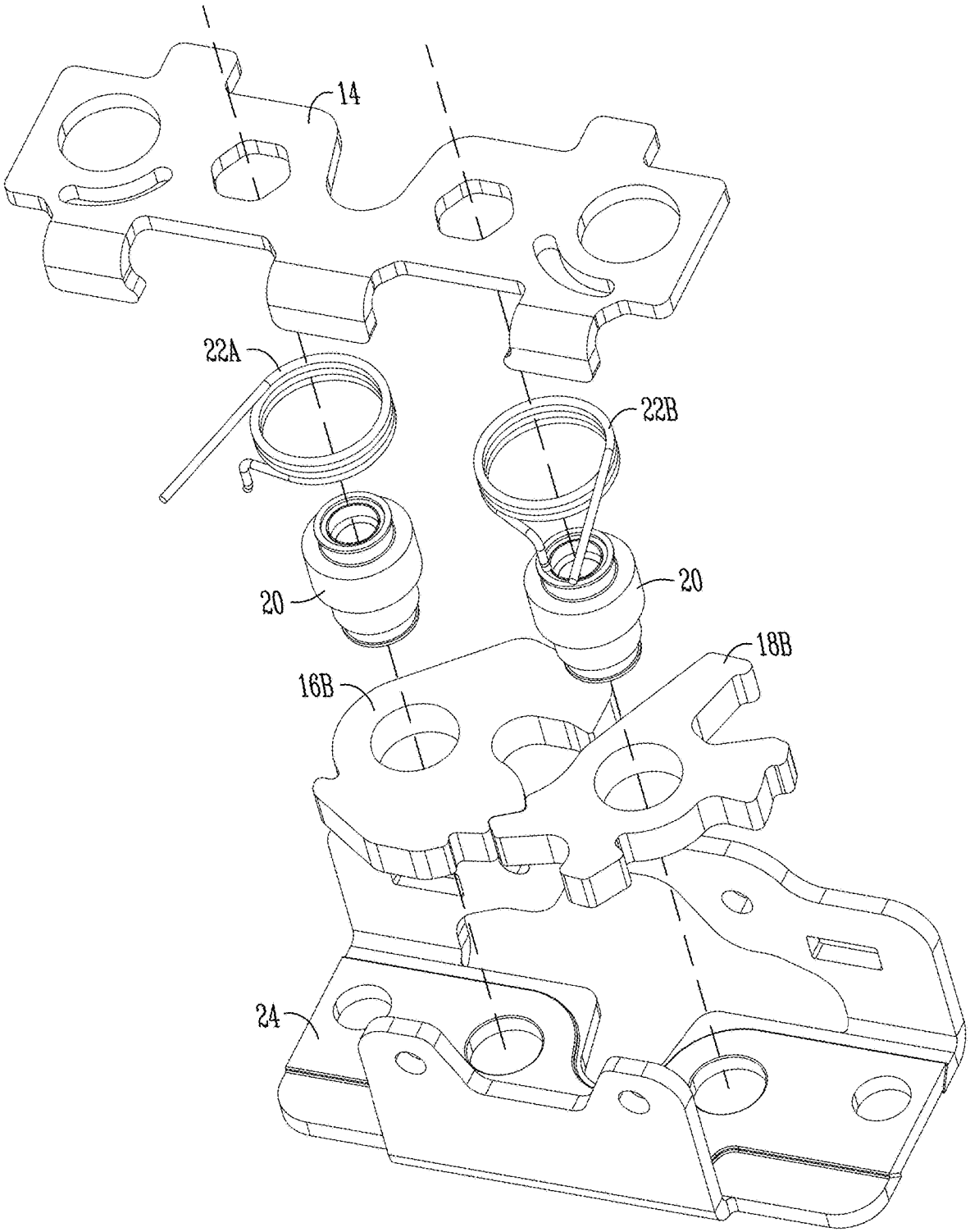
FIG. 1A is an exploded perspective view of an alternative embodiment of the latch assembly of the present invention for right-handed application using the rotor of FIG. 11A and the catch of FIG. 13A.
Figure 2:
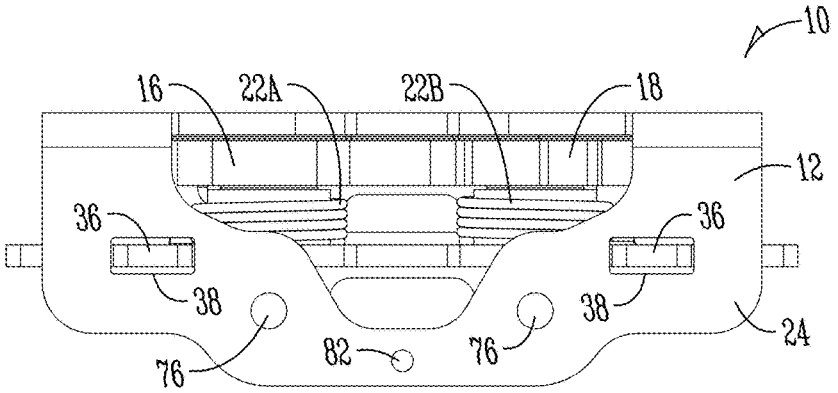
FIG. 2 is a top plan view of the latch assembly shown in FIG. 1.
Figure 3:
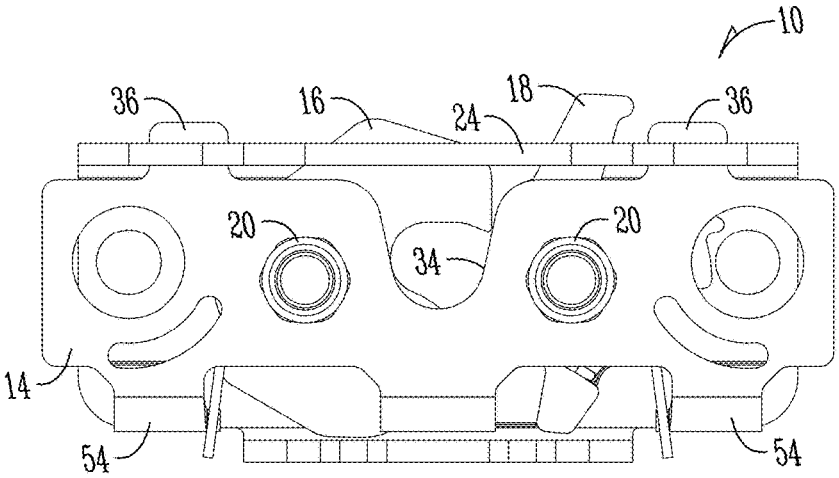
FIG. 3 is front elevation view of the latch assembly shown in FIG. 1, with the rotor and catch in a latched position.
Figure 4:
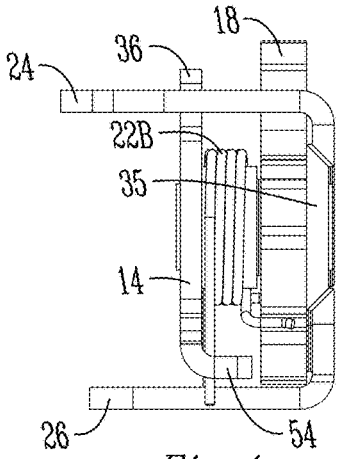
FIG. 4 is a right end view of the latch assembly shown in FIG. 1.
Figure 5:
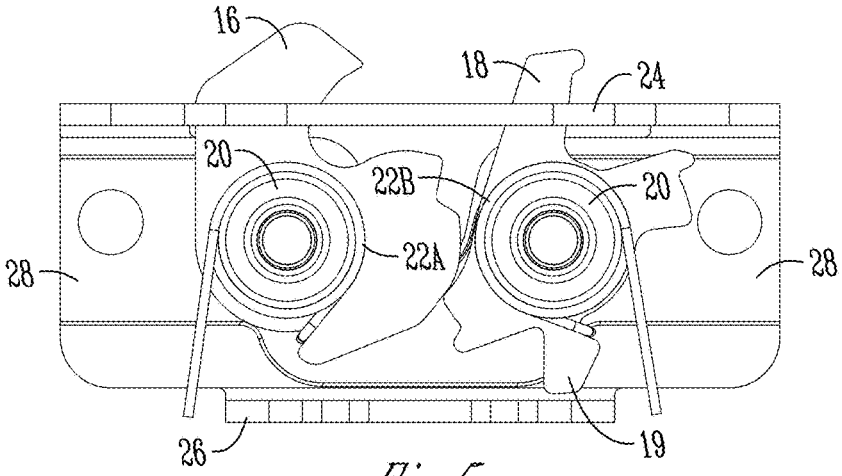
FIG. 5 is a view similar to FIG. 3, with the back plate removed to show the internal components, with the rotor and catch in an unlatched position.
Figure 11A:
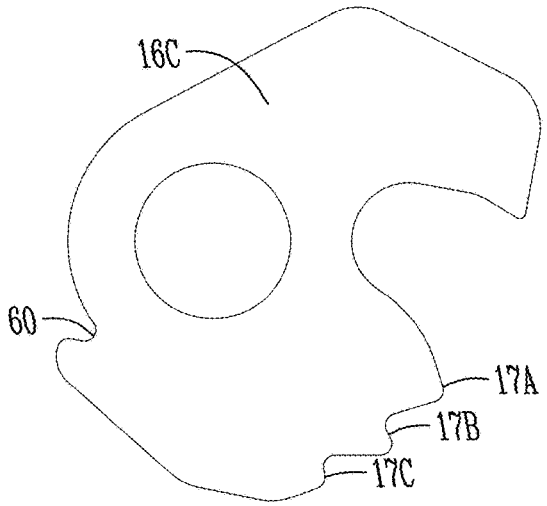
FIG. 11A is a plan view of an alternative embodiment of a two position rotor for use in the latch assembly of the present invention.
Figure 12A:
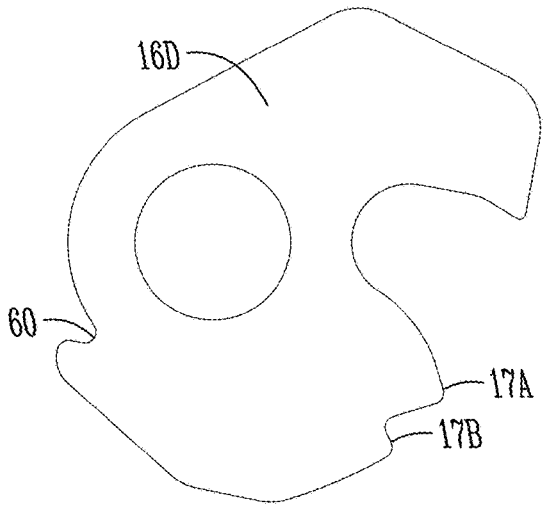
FIG. 12A is a plan view of yet another embodiment of a one-position rotor for use in the latch assembly of the present invention.
Figure 13:
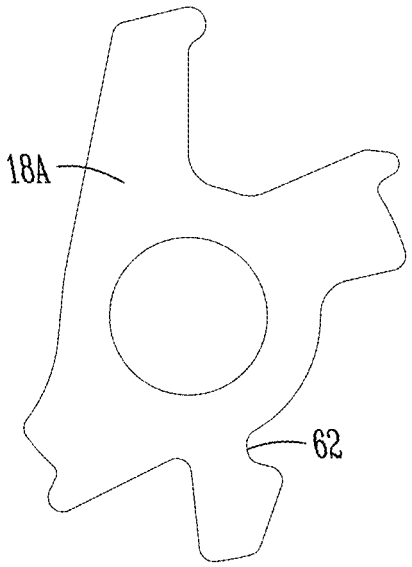
FIG. 13 is a plan view of the catch of the latch assembly.
Figure 13A:
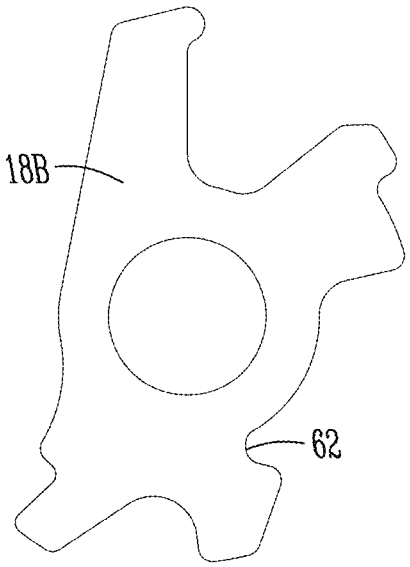
FIG. 13A is a plan view of an alternative embodiment of the catch of the latch assembly.
Figure 14:
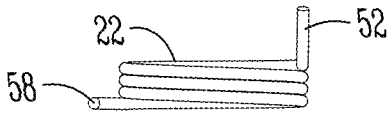
FIGS. 14-16 are views of one of the springs of the latch assembly, with the other spring being a mirror image.
Figure 15:
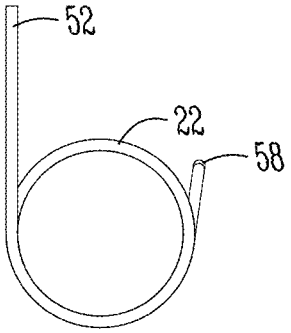
Figure 16:
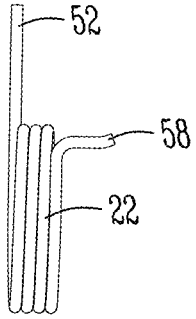
Figure 17:
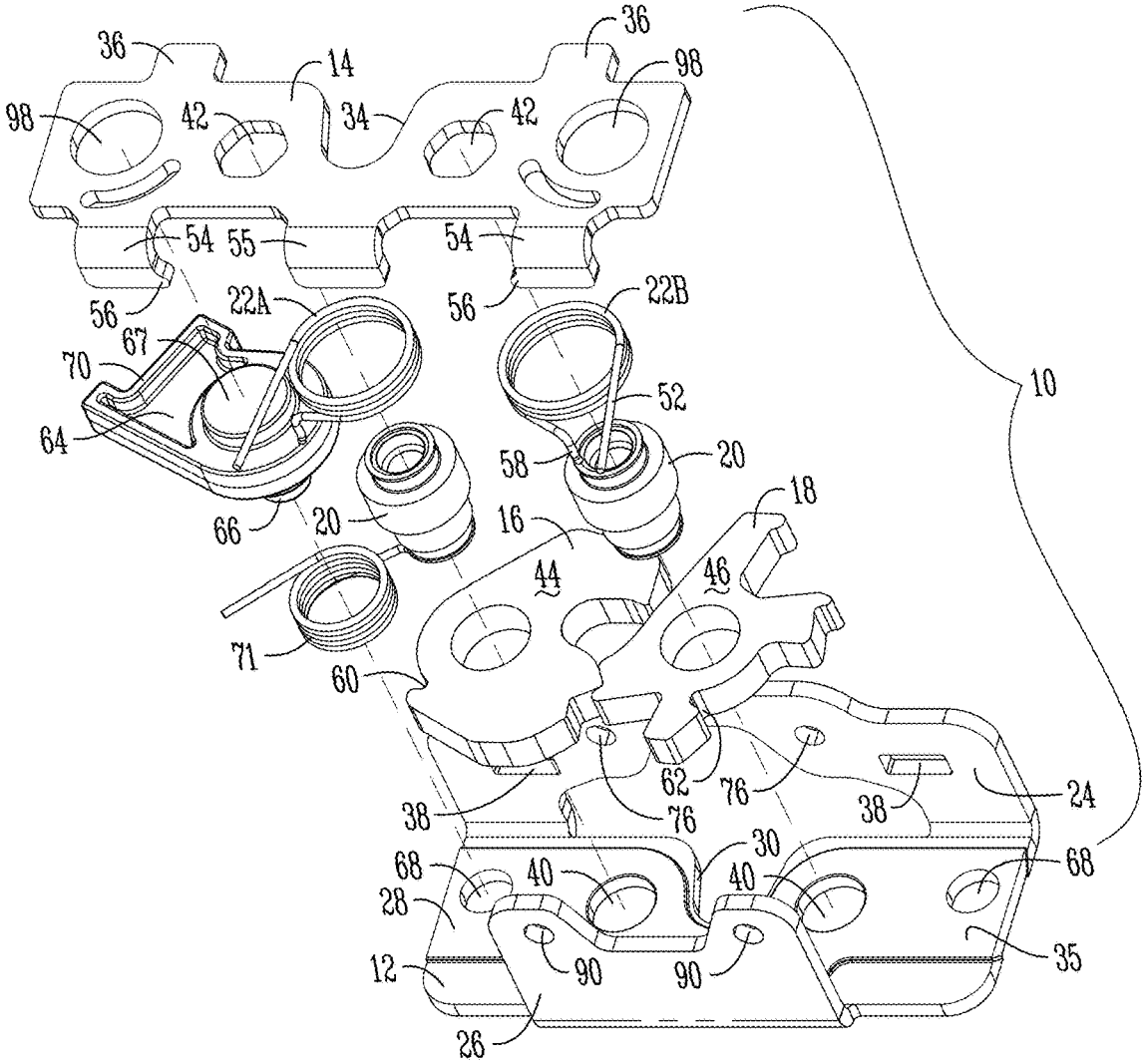
FIG. 17 is an exploded perspective view of another embodiment of the latch assembly including a lifting block, with the components configured for a right-handed latch.
Figure 18:
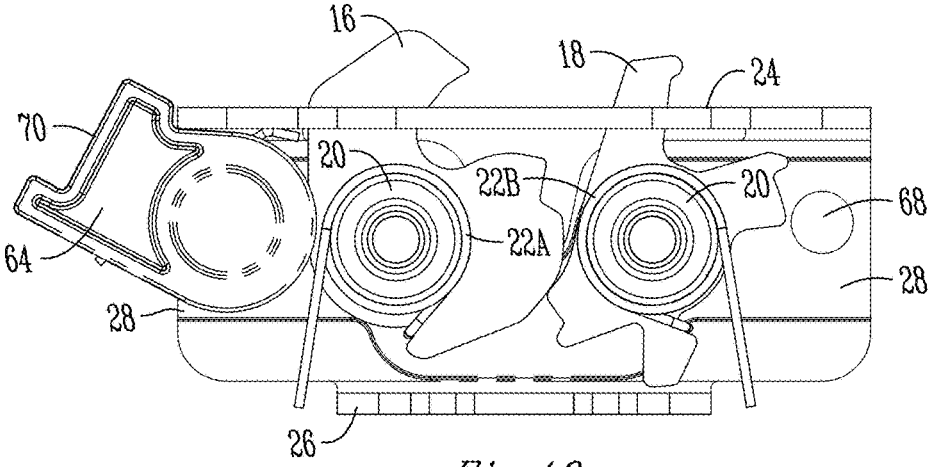
FIG. 18 is a rear plan view of the latch assembly shown in FIG. 17, with the back plate removed to show the internal components in an unlatched position.
Figure 19:
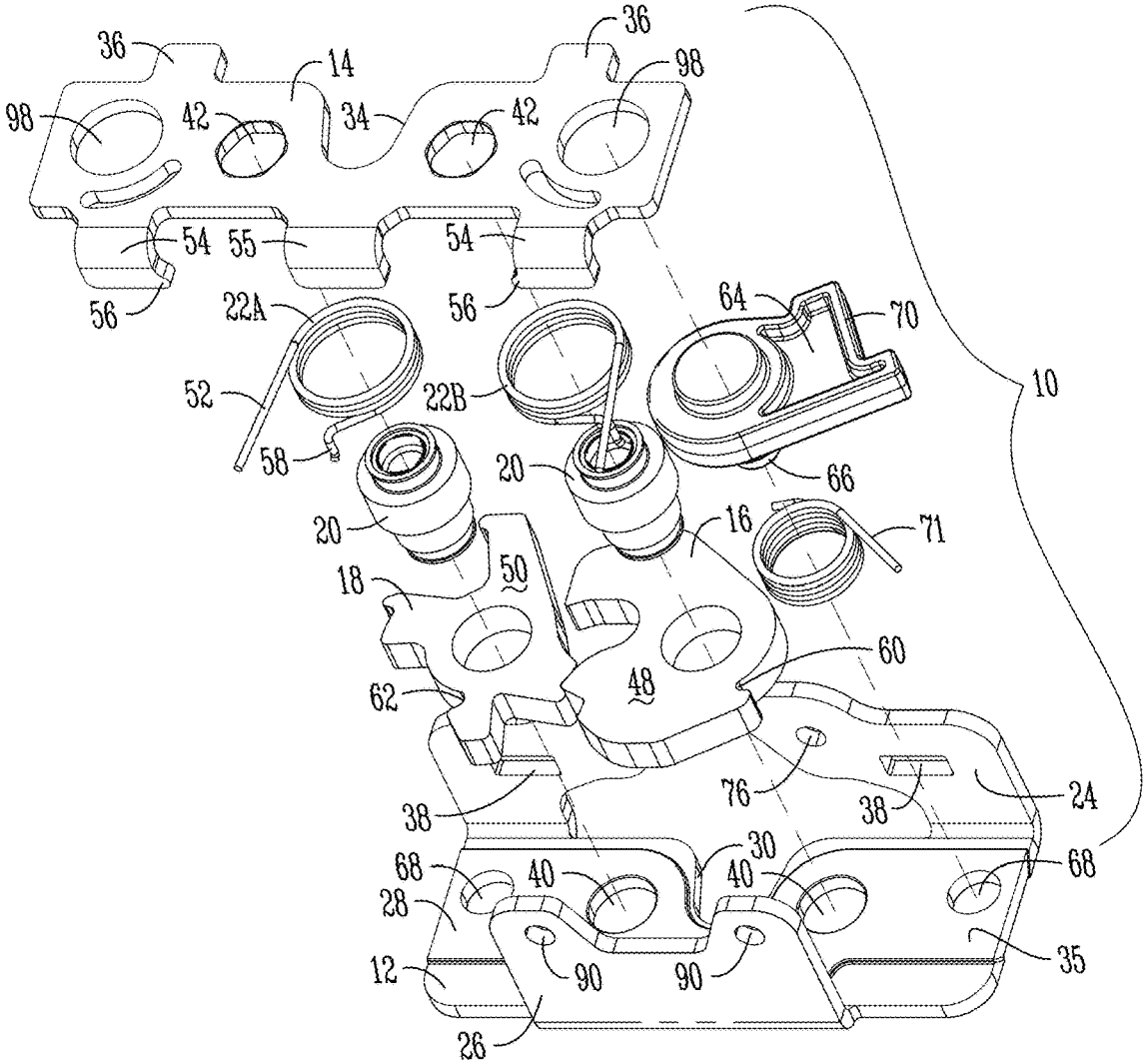
FIG. 19 is an exploded perspective view of another embodiment of the latch assembly including a lifting block, with the components configured for a left-handed latch.
Figure 20:
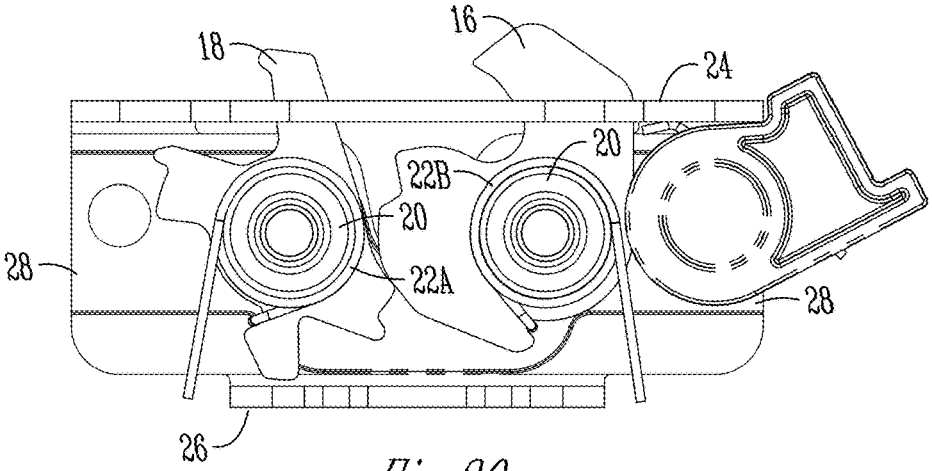
FIG. 20 is a rear plan view of the latch assembly shown in FIG. 19, with the back plate removed to show the internal components in an unlatched position.

FIGS. 11A and 12A show alternative embodiments of a rotor, while FIG. 13A shows an alternative embodiment of a catch, for use in the latch assembly 10. More particularly, the rotor 16*c* is a two-position rotor, with engagement points 17*a*, 17*b*, and 17*c*, as shown in FIG. 11A. The rotor 16*d* of FIG. 12A, is a one-position rotor, with engagement points 17*a*, 17*b*. The alternative catch 18*b* of FIG. 13A can be used with either of the rotors 16*c* and 16*d*. The rotors 16*c* and 16*d* and catch 18*b* provide for reduced rotation of the catch, and thus reduces the travel of the rotor and catch combination. This reduced travel is important for versions of the latch assembly which utilize a barrel actuator, which allows for a wider range of handles for the latch assembly. It should be stated that the two-position rotor 16A and catch 18A and two-position rotor 16C and catch 18B are interchangeable in assembly 10 as described above for primary vehicle doors allowing driver and passengers to enter and exit the vehicle as required by Government regulations, this is clearly shown in FIGS. 1 and 1A as to their interchangeability.

The front plate 12 has opposite ends which are mirror images of one another relative to a line or plane passing through the center of the front plate. Similarly, the back plate 14 has opposite ends which are mirror images of one another relative to a line or plane passing through the center of the back plate. This symmetrical design of the front and back plates allows for increased versatility of the latch assembly 10.

Another alternative for the latch assembly 10 is the provision of a lifting block 64, as shown in FIGS. 17-20. The lifting block 64 can be mounted on either end of the front plate 12, depending on the left or right hand configuration. The lifting block 64 includes a stub shaft 66 mountable in one of the holes 68 at opposite ends of the front plate 12. The lifting block also has stub shaft 67 for receipt in one of the holes 98 at opposite ends of the back plate 14. If the latch assembly 10 is out of alignment with the striker 32, as shown in FIG. 22, the lifting block 64 functions to lift the latch assembly 10 during closing of the door so as to align the striker 32 with the windows 30 and 34 in the front and back plates 12 and 14, respectively, so that the rotor 16 and the catch 18 can move to the latched position capturing the striker 32. More particularly, as the ramp surface 70 of the lifting block 64 engages the mounting base 72 of the striker 32 (FIG. 22), the continued movement of the latch assembly 10 toward the striker 32 will pivot the lifting block 64 about the axis of the shafts 66, 67, thereby raising the latch assembly 10 into proper alignment with the striker 32 (FIG. 21).

The latch assembly 10 is also designed for multiple options for a barrel actuator for releasing the catch 18 and the rotor 16 from the latched position to the unlatched position. For example, one or more actuators or trip levers 74, 86, 92 and 96 can be secured in the holes 76, 90, 98 and 86 respectively in the latch plates. Since each plate 12 and 14 is symmetrical, the actuators can be mounted for both left-handed and right-handed latch assemblies. The actuators are connected to manual door handles or power assist mechanisms, as is known in the art, so that actuation releases the catch 18, and thereby the rotor 16, from the latched position to the unlatched position. FIGS. 23-58 show various alternatives for these unlatching actuators.

In one actuator option shown in FIGS. 23-27, a trip lever 74 is mounted on the top flange 24 of the front plate 12. More particularly, the trip lever 74 is mounted in a hole 76 in the top flange 24 via a rivet or pin 78. A spring 80 is mounted on the rivet 78 and has a first end retained in the hole 82 in the top flange 24 and a second end engaging a hook 84 on the lever 74. The spring 80 biases the trip lever 74 to a returned position. The hole 82 is centered so as to provide an indicia for aligning the latch assembly 10 on a door frame.

A second option for the latch assembly actuator is shown in FIGS. 28-32, wherein a second trip lever 86 is mounted on the bottom flange 26 of the front plate 12 via a rivet 88 extending through a hole 90 in the bottom flange 26.

In another actuator alternative shown in FIGS. 33-37, a third trip lever 92 is mounted in both of the coaxial holes 76 and 90 of the flanges 24 and 26, respectively, via a rivet 94.

In yet another alternative, a rotary barrel actuator 96 can be used to trip the catch 18 and the rotor 16 from the latched to the unlatched positions. The rotary actuator 96 is mounted in a hole 98 in the back plate 14 and hole 68 in the front plate 12 and retained by a spring clip 100.

A dual actuator option for releasing the rotor and catch from the latched position is shown in FIGS. 38-42 and 45 and 46. In this option, the trip lever 74 and rotary actuator 96 are both mounted on the latch assembly, as described previously.

In yet another alternative, the rotary actuator 96 can be used with the second trip lever 86, as seen in FIGS. 28-32, and FIGS. 47 and 48.

The third trip lever 92 can also be used in combination with the rotary actuator 96, as seen in FIGS. 33-37 and FIGS. 49 and 50.

Figure 51:
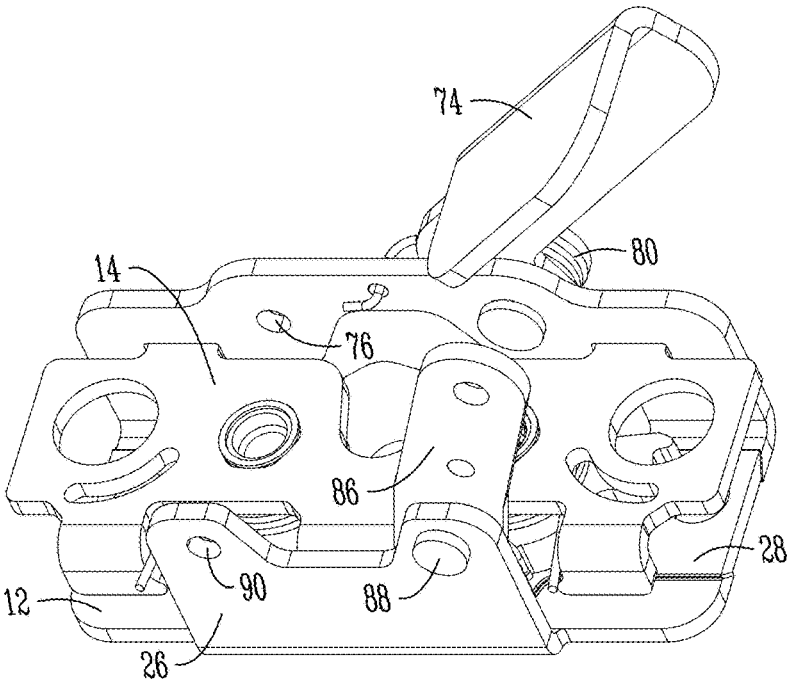
FIG. 51 is a perspective view of a latch assembly according to the present invention having dual trip levers.
Figure 52:
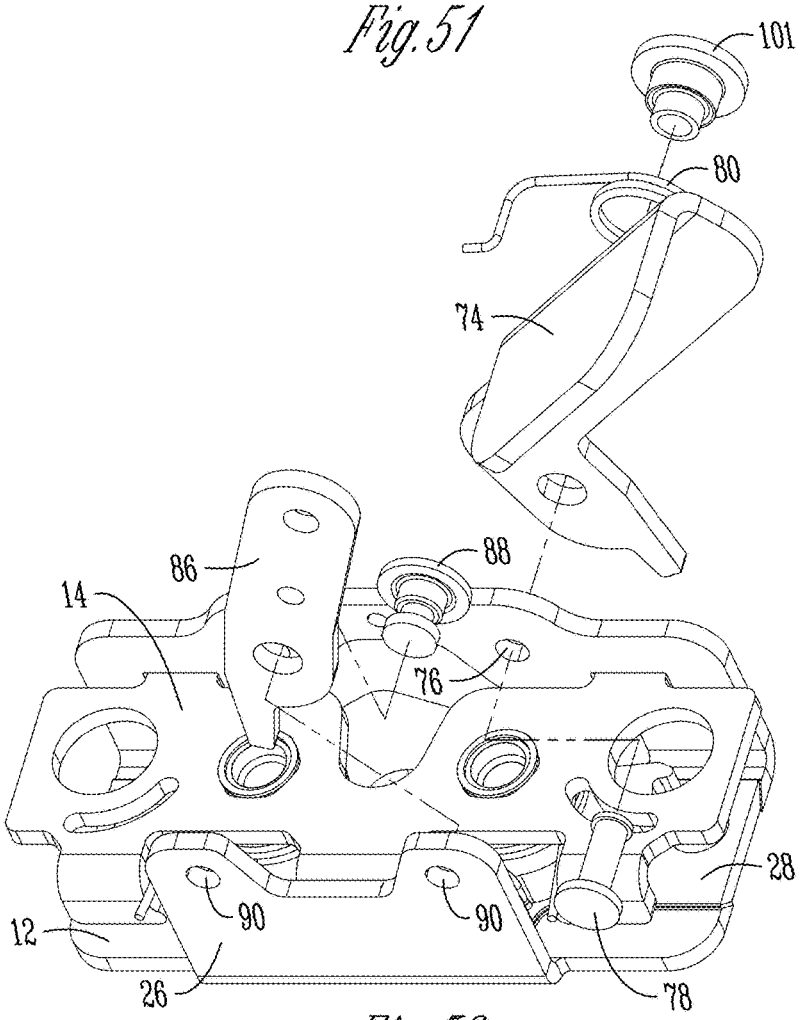
FIG. 52 is a partially exploded perspective view of the latch assembly of FIG. 51.

Another dual actuator option is shown in FIGS. 51, 52, wherein the trip levers 74 and 86 are both utilized on the latch assembly 10. While the actuator FIGS. 23-58 show the positions of the various actuators or trip levers for a right-handed latch assembly, it is understood that these actuators are also used in a similar manner for a left-handed latch assembly using corresponding holes in the plates 12 and 14. The symmetrical or mirror image design of the plates 12 and 14 thus provide multiple mounting options for the various trip levers 74, 86, and 92, as well as the rotary actuator 96.

Figure 57:
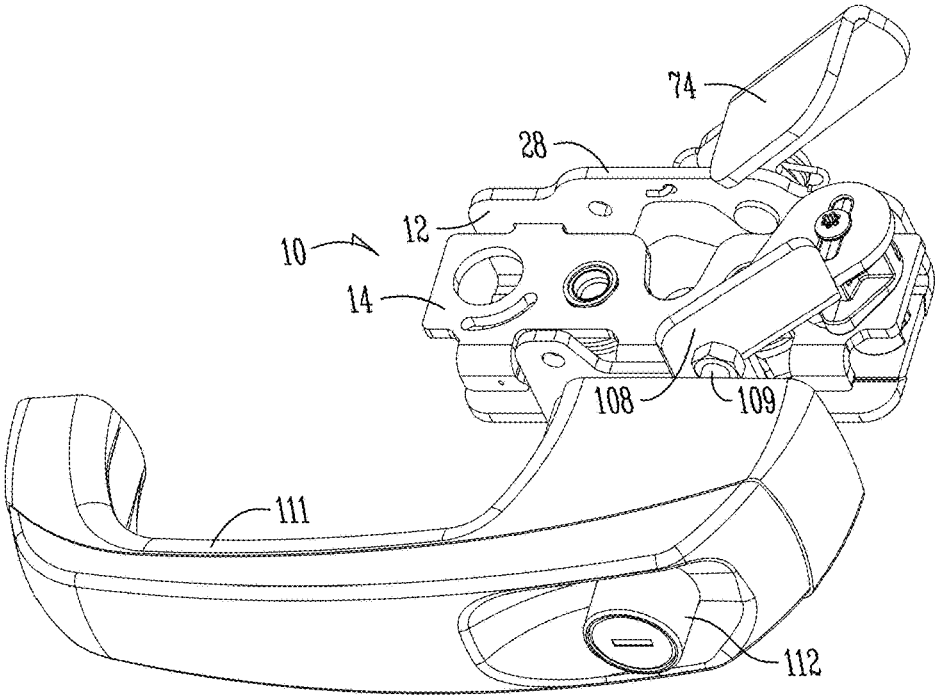
FIG. 57 is a perspective view showing an embodiment of the latch assembly with a push button handle.
Figure 58:
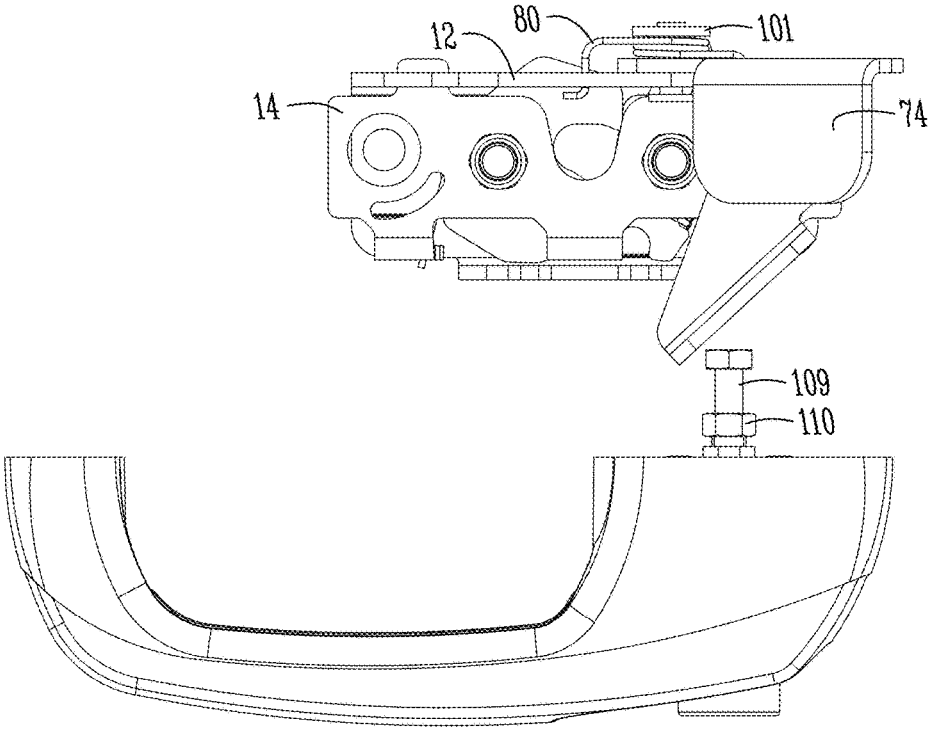
FIG. 58 is a plan view of the latch assembly and push button handle shown in FIG. 57.

The latch assembly of the present invention can be used with various types of door handles. One example is shown in FIGS. 57 and 58, wherein the handle 111 includes a push button actuator 112 having a post 109 which engages a lever 108 mounted on the latch assembly 10. The handle 111 is not limited to a push button type, but, for example, could also include a pull type handle or a rotating handle.

Figure 53:
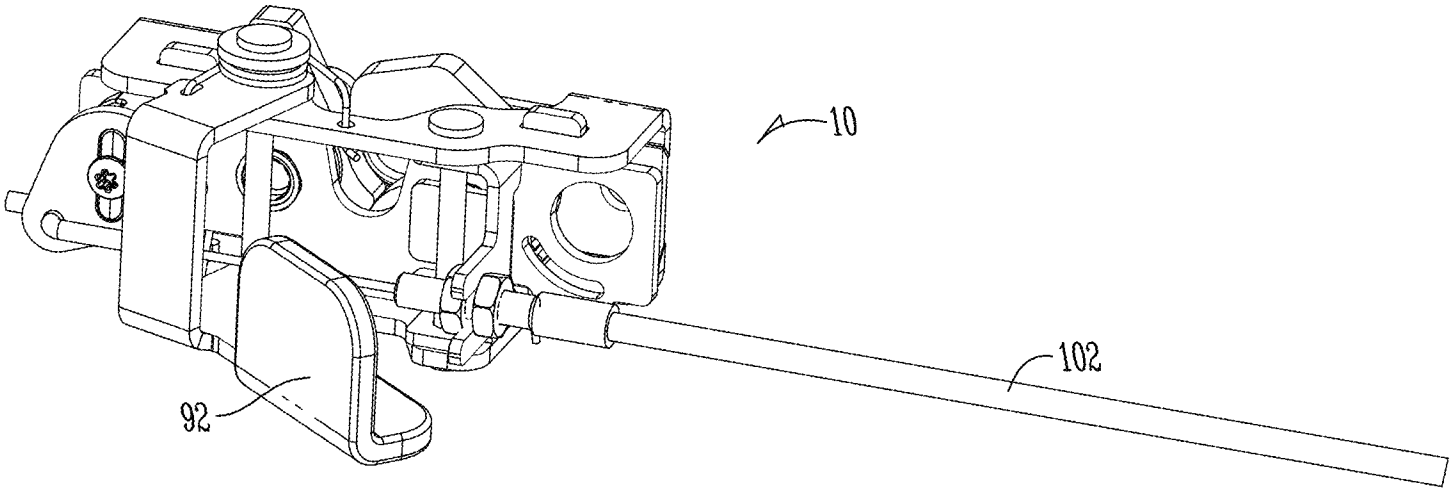
FIG. 53 is a perspective view of the latch assembly connected to a cable release actuator.
Figure 54:
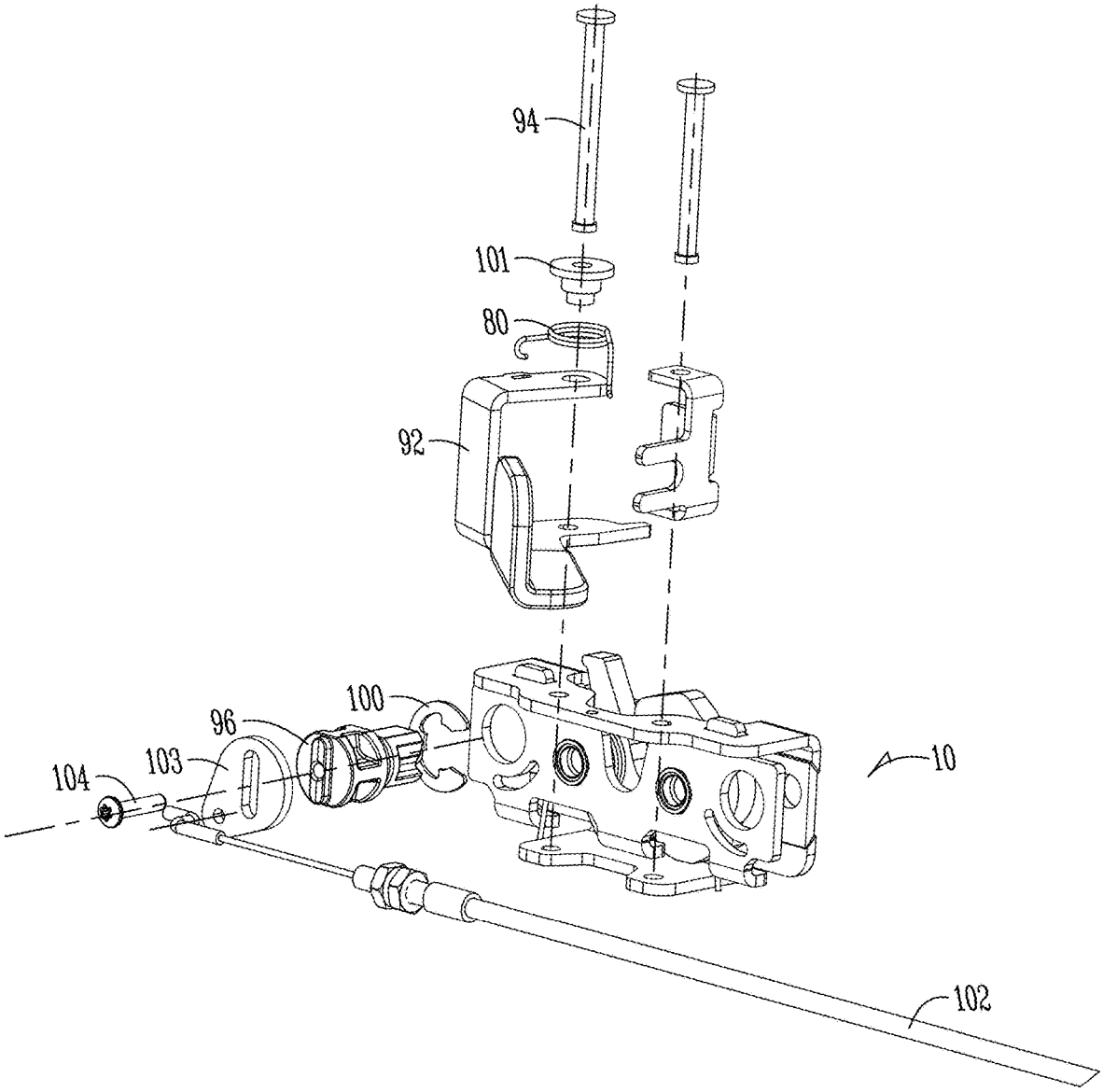
FIG. 54 is an exploded view of the assembly shown in FIG. 53.

FIGS. 53 and 54 show another variation of the latch assembly 10 operably connected to a cable 102 which is connected to a door handle (not shown). When the door handle is activated by a user, the handle connection pulls the cable 102, which in turn actuates the barrel actuator 96 through a tear drop shaped cam 103 mounted to actuator 96 by screw 104. This actuation rotates the barrel actuator 96, which then rotates the catch 18 and releases the latch assembly 10 to unlatched.

Figure 55:
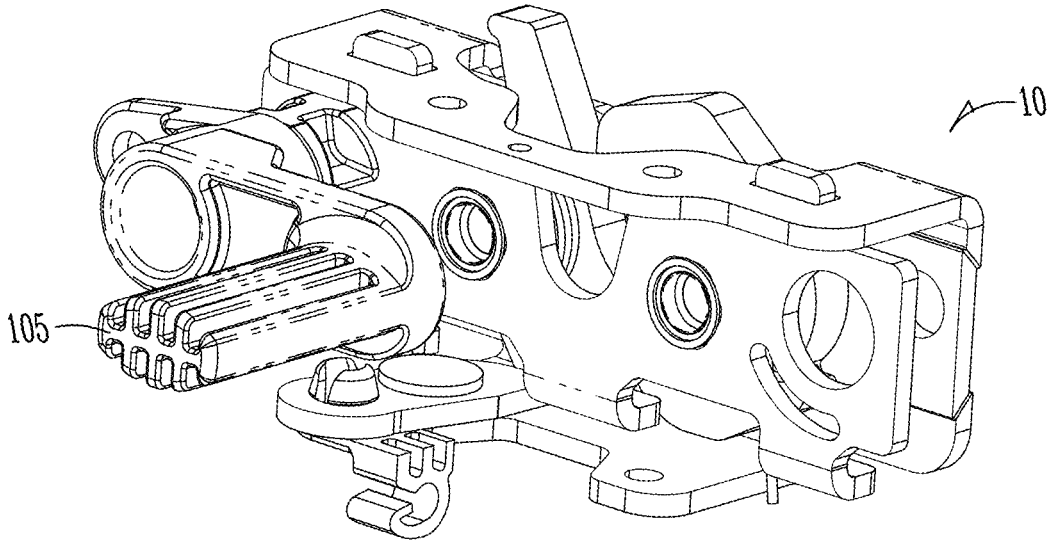
FIG. 55 is a perspective view of the latch assembly with a customized plastic release lever.
Figure 56:
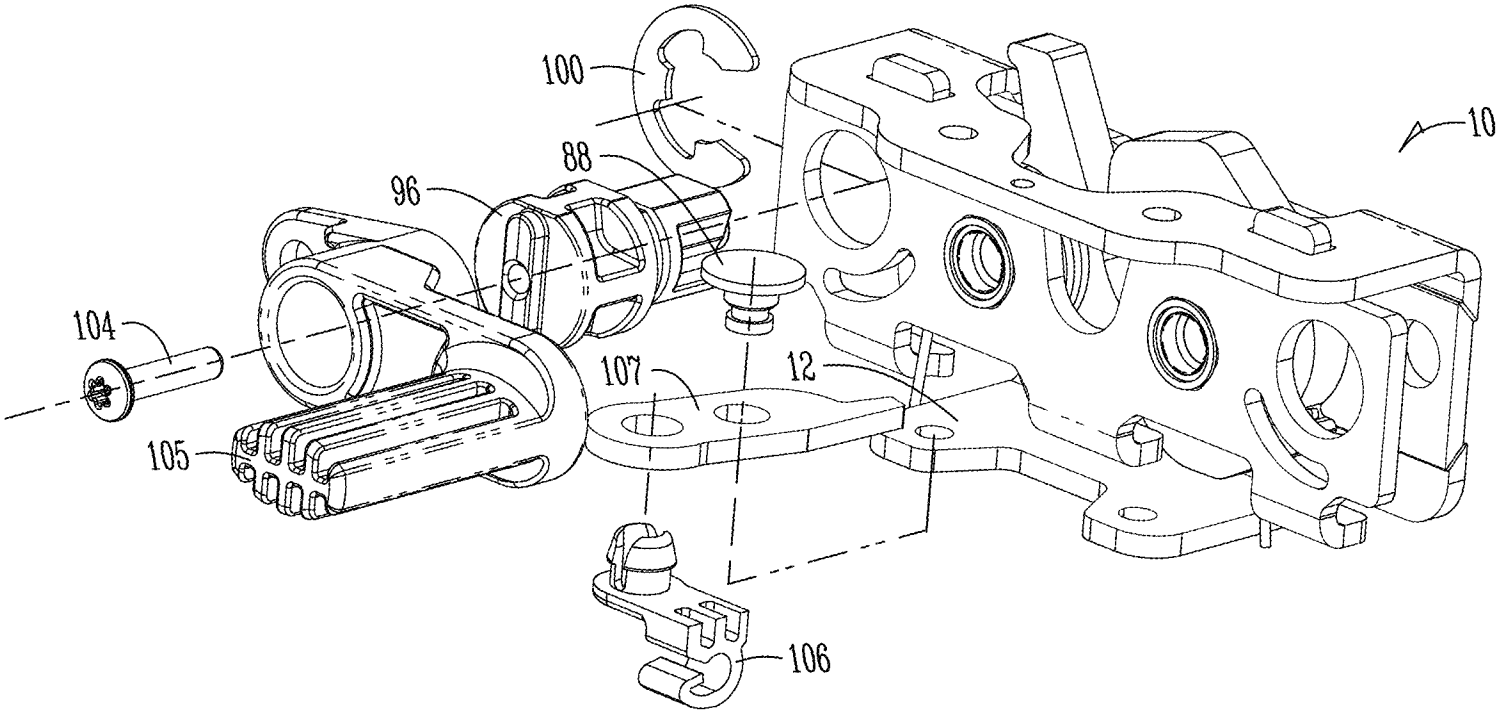
FIG. 56 is an exploded view of the assembly shown in FIG. 55.

FIGS. 55 and 56 show the latch assembly 10 with a customized plastic release 105 mounted on the barrel actuator 96 by a screw 104. A trip lever 107 is mounted to the front plate 12 via a rivet 88 and actuation cable (not shown) is connected to the trip lever 107 by a connector 106. The plastic release 105 can have different designs configurable for different applications, thus allowing the barrel actuator 96 to accept multiple custom inside release levers, in a manner similar to that shown in FIGS. 53-56.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

We claim:

1. A rotary latch assembly comprising:

a front plate;

a back plate connected to the front plate;

a pair of axles mounted between the front and back plates;

a rotor rotatively mounted on one of the axles for movement between latched and unlatched functional positions;

a catch rotatively mounted on the other one of the axles for movement between latched and unlatched functional positions;

the rotor and catch each having opposite first and second faces, and each being mountable in a first mounting position on the axles with the first faces directed outwardly to form a right-handed latch and in a second mounting position on the opposite axles with the second faces directed outwardly to form a left-handed latch; and the front and back plates being oriented the same in both the right-handed and left-handed latches.

2. The rotary latch assembly of claim 1 wherein the rotor and catch are each flipped 180 degrees between the first and second mounting positions.

3. The rotary latch assembly of claim 1 wherein the first and second axles are identical so that the rotor and catch can be mounted on opposite ones of the axles in the first and second mounting positions.

4. The rotary latch assembly of claim 1 further comprising a pair of springs mounted on the axles, respectively, and each spring engaging one of the rotor and catch to bias the rotor and catch to one of the functional positions.

5. The rotary latch assembly of claim 1 wherein the springs are mirror images of one another so that each spring can be used with the rotor and the catch.

6. The rotary latch assembly of claim 1 wherein the front plate is symmetrical and has opposite mirror image ends extending from a center line.

7. The rotary latch assembly of claim 1 wherein the back plate is symmetrical and has opposite mirror image ends extending from a center line.

8. The rotary latch assembly of claim 1 further comprising multiple attachment points on the plates for actuators and trip levers.

9. The rotary latch assembly of claim 8 wherein the attachment points are located on top and bottom flanges of the front and back plates.

10. The rotary latch assembly of claim 1 further comprising a barrel actuator mounted on the front and back plate.

11. The rotary latch assembly of claim 1 further comprising dual actuators or trip levers mounted on the assembly to actuate the catch.

12. The rotary latch assembly of claim 11 wherein one of the dual actuators or trip levers is mounted on the front plate and the other of the dual actuators or trip levers is mounted on the back plate.

13. The rotary latch assembly of claim 11 wherein the dual actuators or trip levers are both mounted on the front plate.

14. The rotary latch assembly of claim 1 further comprising a tab on the back plate to limit rotational movement of the trip levers.

15. The rotary latch assembly of claim 1 further comprising a lift block mounted on the plates to facilitate alignment of the latch with a striker.

16. The rotary latch assembly of claim 1 wherein the lift block is mounted at one end of the plates for a left-handed latch and at an opposite end of the front plate for a right-handed latch.

17. A rotary latch assembly, comprising:

front and back plates connected together;

a pair of axles extending between the front and back plates;

a rotor and a catch interchangeably mounted on the axles;

the plates each being symmetrical about a center lines so as to form left and right-handed latches when the rotor and catch are exchanged on the axles; and multiple attachment points on the plates for mounting an actuator or trip lever.

18. The rotary latch assembly of claim 17 wherein the connection between the front and back plates is the same for the left-handed and right-handed latches.

19. The rotary latch assembly of claim 17 wherein the rotor and catch are each flipped front to back when exchanged on the axles.

20. The rotary latch assembly of claim 17 further comprising a pair of springs mounted on the axles, respectively, and each spring engaging one of the rotor and catch to bias the rotor to an unlatched position and to bias the catch to a latched position.

21. The rotary latch assembly of claim 17 wherein the springs are mirror images of one another so that each spring can be used with the rotor or the catch.

22. The rotary latch assembly of claim 17 wherein the attachment points are located on top and bottom flanges of the front plate, and on the back plate.

23. The rotary latch assembly of claim 17 further comprising a barrel actuator mounted on the back plate.

24. The rotary latch assembly of claim 17 further comprising dual actuators or trip levers mounted on the assembly to actuate the catch.

25. The rotary latch assembly of claim 24 wherein one of the dual actuators or trip levers is mounted on the front plate and the other of the dual actuators or trip levers is mounted on the back plate.

26. The rotary latch assembly of claim 24 wherein the dual actuators or trip levers are both mounted on the front plate.

27. The rotary latch assembly of claim 17 further comprising a tab on the back plate to limit rotational movement of the trip levers.

28. The rotary latch assembly of claim 17 further comprising a lift block mounted on the assembly to facilitate alignment of the latch with a striker.

29. The rotary latch assembly of claim 17 wherein the lift block is mounted at one end of the assembly for a left-handed latch and at an opposite end of the assembly for a right-handed latch.

30. A rotary latch assembly, comprising:

front and back plates connected together;

a pair of axles extending between the front and back plates;

a rotor and a catch interchangeably mounted on the axles;

the plates each being symmetrical about a center line so as to form left and right-handed latches when the rotor and catch are exchanged on the axles;

dual actuators or trip levers mounted on the assembly to actuate the catch; and wherein one of dual actuators or trip levers is mounted on the front plate and the other of the dual actuators or trip levers is mounted on the back plate.

31. A rotary latch assembly, comprising:

front and back plates connected together;

a pair of axles extending between the front and back plates;

a rotor and a catch interchangeably mounted on the axles;

the plates each being symmetrical about a center line so as to form left and right-handed latches when the rotor and catch are exchanged on the axles;

dual actuators or trip levers mounted on the assembly to actuate the catch; and wherein the dual actuators or trip levers are both mounted on the front plate.

32. A rotary latch assembly, comprising:

front and back plates connected together;

a pair of axles extending between the front and back plates;

a rotor and a catch interchangeably mounted on the axles;

the plates each being symmetrical about a center line so as to form left and right-handed latches when the rotor and catch are exchanged on the axles; and a tab on the back plate to limit rotational movement of the trip levers.

* * * * *